US007736137B2

(12) United States Patent
Ueno et al.

(10) Patent No.: US 7,736,137 B2
(45) Date of Patent: Jun. 15, 2010

(54) SCROLL COMPRESSOR

(75) Inventors: Hiroharu Ueno, Iwanuma (JP); Yasushi Terayama, Sakura (JP); Yu Sasaki, Shibata-gun (JP); Yusuke Nishimura, Sendai (JP)

(73) Assignee: Keihin Corporation, Tokyo (JP)

( * ) Notice: Subject to any disclaimer, the term of this patent is extended or adjusted under 35 U.S.C. 154(b) by 178 days.

(21) Appl. No.: 11/988,064

(22) PCT Filed: Jun. 28, 2006

(86) PCT No.: PCT/JP2006/312926

§ 371 (c)(1),
(2), (4) Date: Dec. 28, 2007

(87) PCT Pub. No.: WO2007/001034

PCT Pub. Date: Jan. 4, 2007

(65) Prior Publication Data

US 2009/0169406 A1 Jul. 2, 2009

(30) Foreign Application Priority Data

Jun. 29, 2005 (JP) ..... 2005-190283

(51) Int. Cl.
*F04C 18/04* (2006.01)
*F04C 29/02* (2006.01)

(52) U.S. Cl. ..... 418/55.6; 418/55.2; 418/89; 418/99; 418/DIG. 1

(58) Field of Classification Search ..... 418/55.1, 418/55.2, 55.6, 83, 89, 97, 99, 100, DIG. 1
See application file for complete search history.

(56) References Cited

U.S. PATENT DOCUMENTS

| | | | | |
|---|---|---|---|---|
| 6,227,831 | B1 | 5/2001 | Osima et al. | |
| 6,755,632 | B1 | 6/2004 | Ito et al. | |
| 2002/0136652 | A1 * | 9/2002 | Gennami et al. | 418/55.6 |
| 2004/0253133 | A1 * | 12/2004 | Gennami et al. | 418/55.1 |

FOREIGN PATENT DOCUMENTS

| | | |
|---|---|---|
| JP | 11-082335 | 3/1999 |
| JP | 2000-80995 | 3/2000 |
| JP | 2003-232285 | 8/2003 |

* cited by examiner

*Primary Examiner*—Thomas E Denion
*Assistant Examiner*—Mary A Davis
(74) *Attorney, Agent, or Firm*—Lahive & Cockfield, LLP; Anthony A. Laurentano, Esq.

(57) ABSTRACT

A scroll compressor, wherein a guide passage facing the supply passage of a fixed side substrate part is formed at the outer peripheral portion of a fixed scroll engaged with a movable scroll along the axial direction of the fixed scroll. A lubricating oil is stored in an oil storage tank surrounded by a set of weir walls formed along the guide passage and the movable side substrate part of the movable scroll facing a fixed side spiral wall. The movable side substrate part is radially displaced by the turning action of the movable scroll to supply the lubricating oil stored in the oil storage tank to the movable scroll side.

5 Claims, 14 Drawing Sheets

SCROLL COMPRESSOR

RELATED APPLICATIONS

This application is a 35 U.S.C. 371 national stage filing of International Application No. PCT/JP2006/312926, filed 28 Jun. 2006, which claims priority to Japan Patent Application No. 2005-190283 filed on 29 Jun. 2005 in Japan. The contents of the aforementioned applications are hereby incorporated by reference.

TECHNICAL FIELD

The present invention relates to a scroll compressor having a fixed scroll and a movable scroll which interleave each other and define a compression chamber, for compressing a fluid upon orbiting movement of the movable scroll.

BACKGROUND ART

Heretofore, there have been known scroll compressors including, in a housing, a fixed scroll having a fixed plate and a spiral fixed lap upstanding on the fixed plate and a movable scroll having a movable plate and a spiral movable lap upstanding on the movable plate, the fixed and movable laps interleaving each other. The movable scroll is caused to orbit by an eccentric drive pin for moving a compression chamber, which is defined by the laps of the fixed and movable scrolls, the fixed plate, and the movable plate, progressively from an outer circumferential region toward a central region to compress a fluid in the compression chamber.

In one such scroll compressor disclosed in Japanese Laid-Open Patent Publication No. 11-082335, a movable scroll and a fixed scroll are disposed in a front housing, and the fixed scroll is fixed to a rear housing connected to an end of the front housing. A refrigerant that is compressed by the movable scroll and the fixed scroll is introduced through an inlet hole defined in the rear housing into a separation chamber having a separation pipe. Thereafter, the refrigerant and a lubricating oil contained in the refrigerant are separated from each other, and the lubricating oil is discharged through a discharge hole into an oil storage chamber. The fixed scroll has an oil supply hole defined therein which extends from a fixed side plate thereof toward a fixed spiral member. The lubricating oil in the oil storage chamber flows out of the oil supply hole to lubricate the vicinity of sliding portions of the movable and fixed scrolls.

According to the above conventional art, the oil supply hole defined in the fixed scroll is elongate along the axial direction of the fixed scroll and extends through the fixed scroll so as to face the sliding portion of the movable plate of the movable scroll. However, since the oil supply hole is elongate, the efficiency with which to machine the oil supply hole is low.

The oil supply hole that is supplied with the lubricating oil is of a small diameter and has an opening facing a sliding portion of the movable plate of the movable scroll. Therefore, dust or the like enters the oil supply hole from the sliding portion, tending to produce a clogging for the lubricating oil and fail to provide sufficient lubrication.

In order to prevent such a clogging in the oil supply hole, the compressor has a counterbore defined in the opening of the oil supply hole, the counterbore having a diameter larger than the oil supply hole. However, the process of additionally machining the counterbore increases the time required to manufacture the compressor.

DISCLOSURE OF THE INVENTION

It is a main object of the present invention to provide a scroll compressor which is a simple structure, can be machined with an increased efficiency, and prevents a clogging from being produced for a lubricating oil, thereby to supply the lubricating oil reliably.

To achieve the above object, there is provided in accordance with the present invention a scroll compressor comprising an outlet chamber defined between a fixed scroll having a fixed base plate and a fixed spiral wall upstanding on the fixed base plate and a housing, for being supplied with a fluid which is compressed by orbiting movement of a movable scroll interleaving the fixed scroll, a separation chamber held in fluid communication with the outlet chamber, for separating a lubricating oil contained in the fluid, and an oil storage chamber held in fluid communication with the separation chamber, for storing the lubricating oil, wherein the fixed scroll includes a guide passage facing an oil supply hole which is defined in the fixed base plate for flowing the lubricating oil, and extending in an outer circumferential portion of the fixed spiral wall from the fixed base plate along an axial direction of the fixed scroll;

the guide passage being open radially outwardly and not closed.

According to the present invention, the lubricating oil is discharged through the oil supply hole defined in the fixed base plate into the guide passage that extends axially in the outer circumferential portion of the fixed spiral wall, and when the position of the movable base plate with respect to the guide passage is radially displaced upon orbiting movement of the movable scroll, the lubricating oil in the guide passage is supplied beyond the movable base plate to the movable scroll.

Since the oil supply hole is defined axially in the fixed base plate and is open in a region spaced from sliding portions of the fixed spiral wall and the movable base plate, dust, etc. produced at the sliding portions is prevented from entering the oil supply hole, and it is not necessary to provide a clogging prevention means such as a counterbore or the like in the opening of the oil supply hole, as is the case with the conventional scroll compressor.

Accordingly, a clogging for the lubricating oil is prevented from occurring with a simple structure, without the need for performing a complex counterboring process on the oil supply hole. As a result, the sliding portions can reliably and appropriately be lubricated by the lubricating oil supplied through the guide passage.

As the length of the oil supply hole can be made substantially equal to an axial length of the fixed base plate, the oil supply hole can be made shorter than an elongate oil supply hole defined along the fixed side plate and the fixed spiral portion of the conventional scroll compressor. The oil supply hole can thus be machined with ease.

Since the sliding portions of the fixed spiral wall and the movable base plate can be lubricated by the lubricating oil supplied through the guide passage, the lubricating oil can reliably be supplied to the sliding portions to lubricate them without a concern about a clogging for the lubricating oil, compared with the conventional scroll compressor in which the sliding portions are lubricated by the lubricating oil supplied from the oil supply hole.

According to the present invention, there is also provided a scroll compressor comprising an outlet chamber defined between a fixed scroll having a fixed base plate and a fixed spiral wall upstanding on the fixed base plate and a housing, for being supplied with a fluid which is compressed by orbiting movement of a movable scroll interleaving the fixed scroll, a separation chamber held in fluid communication with the outlet chamber, for separating a lubricating oil contained in the fluid, and an oil storage chamber held in fluid communication with the separation chamber, for storing the lubricating oil, wherein the fixed scroll includes an oil passage facing an oil supply hole which is defined in the fixed base plate for flowing the lubricating oil, and extending in an outer circumferential portion of the fixed spiral wall from the fixed base plate along an axial direction of the fixed scroll; and at least one wall upstanding radially outwardly along the oil passage.

According to the present invention, the lubricating oil is discharged through the oil supply hole defined in the fixed base plate into the oil passage that extends axially in the outer circumferential portion of the fixed spiral wall, and flows while being guided by at least one wall upstanding along the oil passage. When the position of the movable base plate with respect to the wall is radially displaced upon orbiting movement of the movable scroll, the lubricating oil in the oil passage is supplied beyond the movable base plate to the movable scroll.

Since the oil supply hole is defined axially in the fixed base plate and is open in a region spaced from sliding portions of the fixed spiral wall and the movable base plate, dust, etc. produced at the sliding portions is prevented from entering the oil supply hole, and it is not necessary to provide a clogging prevention means such as a counterbore or the like in the opening of the oil supply hole, as is the case with the conventional scroll compressor.

Accordingly, a clogging for the lubricating oil is prevented from occurring with a simple structure, without the need for performing a complex counterboring process on the oil supply hole. As a result, the sliding portions can reliably and appropriately be lubricated by the lubricating oil supplied through the oil passage.

As the length of the oil supply hole can be made substantially equal to an axial length of the fixed base plate, the oil supply hole can be made shorter than an elongate oil supply hole defined along the fixed side plate and the fixed spiral portion of the conventional scroll compressor. The oil supply hole can thus be machined with ease.

Since the sliding portions of the fixed spiral wall and the movable base plate can be lubricated by the lubricating oil supplied through the oil passage, the lubricating oil can reliably be supplied to the sliding portions to lubricate them without a concern about a clogging for the lubricating oil, compared with the conventional scroll compressor in which the sliding portions are lubricated by the lubricating oil supplied from the oil supply hole.

The scroll compressor should preferably further comprise an oil storage reservoir surrounded by the oil passage, walls, and a movable base plate of the movable scroll which faces the fixed base plate, wherein the lubricating oil discharged from the oil supply hole is stored in the oil storage reservoir. The lubricating oil discharged through the oil supply hole defined in the fixed base plate into the oil passage is stored in the oil storage reservoir that is surrounded by the oil passage, the walls, and the movable base plate of the movable scroll which faces the fixed base plate. When the position of the movable base plate with respect to the walls is radially displaced upon orbiting movement of the movable scroll, the lubricating oil in the oil storage reservoir is supplied beyond the movable base plate to the movable scroll.

The volume of the oil storage reservoir may vary depending on the distance that the movable base plate is radially displaced with respect to the walls upon orbiting movement of the movable scroll, so that upper and lower limits may be set as desired for the volume of the oil storage reservoir depending on the distance that the movable base plate is radially displaced. Thus, it is possible to freely set the ratio of the supply amount of the lubricating oil supplied when actuating parts for orbiting the movable scroll are lubricated by the lubricating oil flowing beyond the movable base plate, to the supply amount of the lubricating oil supplied when the sliding portions of the movable base plate and the fixed spiral wall are lubricated by the lubricating oil. Since the lubricating oil in the oil storage reservoir can flow toward the movable scroll only when the movable base plate is displaced, the lubricating oil can flow reliably in one direction only.

The volume of the oil storage reservoir may be is set to a minimum value of 0 when the movable base plate is displaced radially inwardly from the fixed spiral wall with the oil passage defined therein. With this arrangement, the entire amount of lubricating oil stored in the oil storage reservoir can be supplied to the actuating parts. Therefore, the actuating parts can reliably and appropriately be lubricated for increased durability and reliability.

According to the present invention, as described above, the oil supply hole in which the lubricating oil flows is defined in the fixed base plate, and is spaced from the sliding portions of the fixed spiral wall and the movable base plate, for thereby preventing dust, etc. produced at the sliding portions from entering the oil supply hole. It is not necessary to provide a clogging prevention means such as a counterbore or the like, as is the case with the conventional scroll compressor. Accordingly, a clogging for the lubricating oil is prevented from occurring with a simple structure, and the sliding portions can reliably be lubricated.

As the length of the oil supply hole can be made substantially equal to the axial length of the fixed base plate, the oil supply hole can be made shorter than an elongate oil supply hole defined along the fixed side plate and the fixed spiral portion of the conventional scroll compressor. The oil supply hole can thus be machined with ease, and the manufacturing time can further be reduced.

BEST MODE FOR CARRYING OUT THE INVENTION

Figure 1:
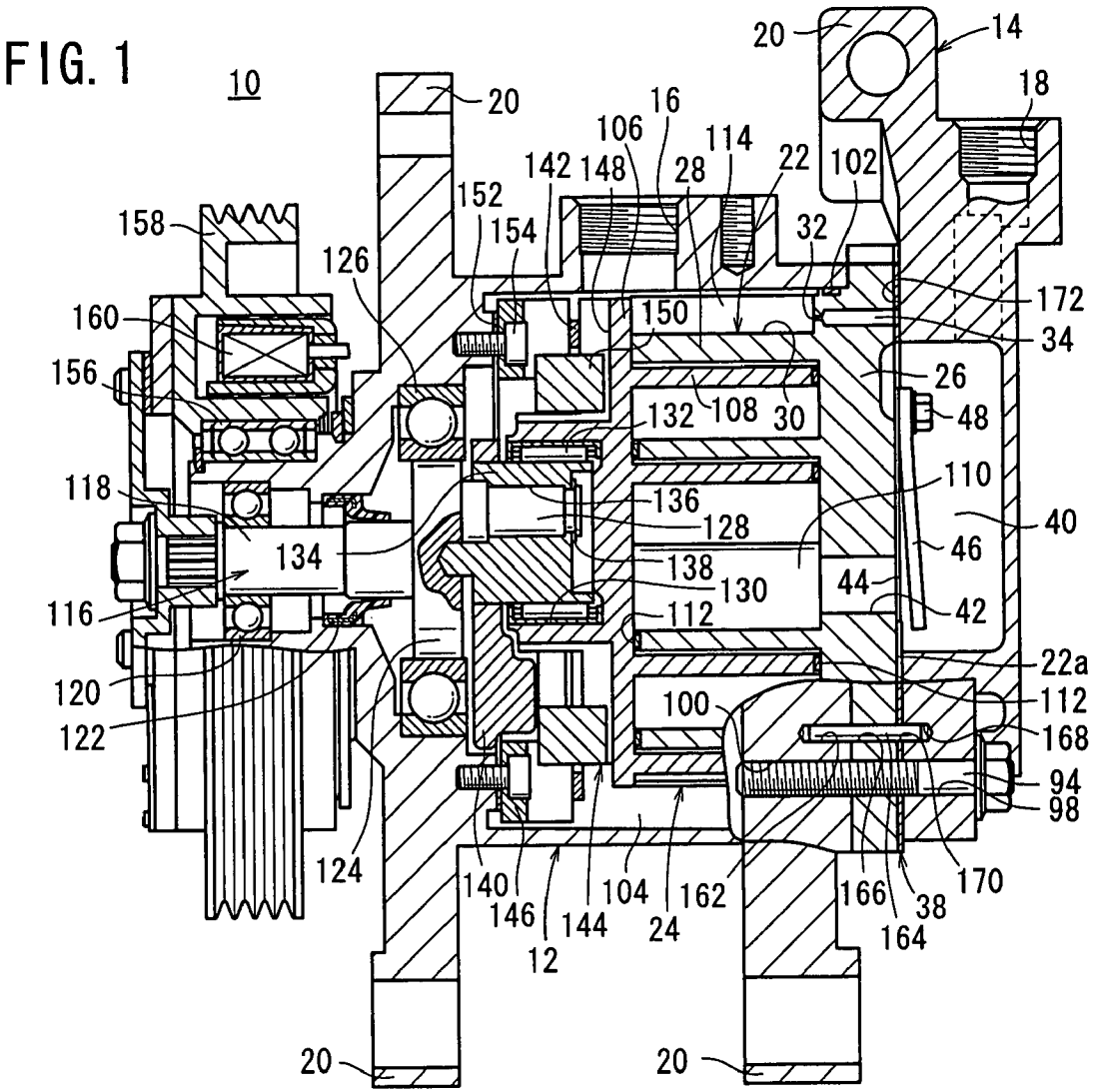
FIG. 1 is a vertical cross-sectional view of an overall scroll compressor according to an embodiment of the present invention.

In FIG. 1, the reference character 10 denotes a scroll compressor according to an embodiment of the present invention.

The scroll compressor 10 comprises a front housing 12 in the form of a cup and a rear housing (housing) 14 coupled to the front housing 12.

The front housing 12 has an inlet port 16 defined in an upper portion thereof for introducing a fluid such as a refrigerant gas or the like into the front housing 12. The rear housing 14 has an outlet port 18 defined in an upper portion thereof for discharging the fluid compressed by the scroll compressor 10 into a refrigerant circulating system, for example. The front housing 12 and the rear housing 14 have a plurality of mounts 20 for mounting the scroll compressor 10 on an engine, an external apparatus, or the like, for example.

The front housing 12 houses therein a fixed scroll 22 and a movable scroll 24 which orbits with respect to the fixed scroll 22, the fixed scroll 22 and the movable scroll 24 being inserted into the front housing 12 from an open end thereof.

The fixed scroll 22 comprises a fixed base plate 26 sandwiched between the front housing 12 and the rear housing 14, and a fixed spiral wall 28 erected in a spiral shape from the fixed base plate 26 toward the movable scroll 24.

Figure 2:
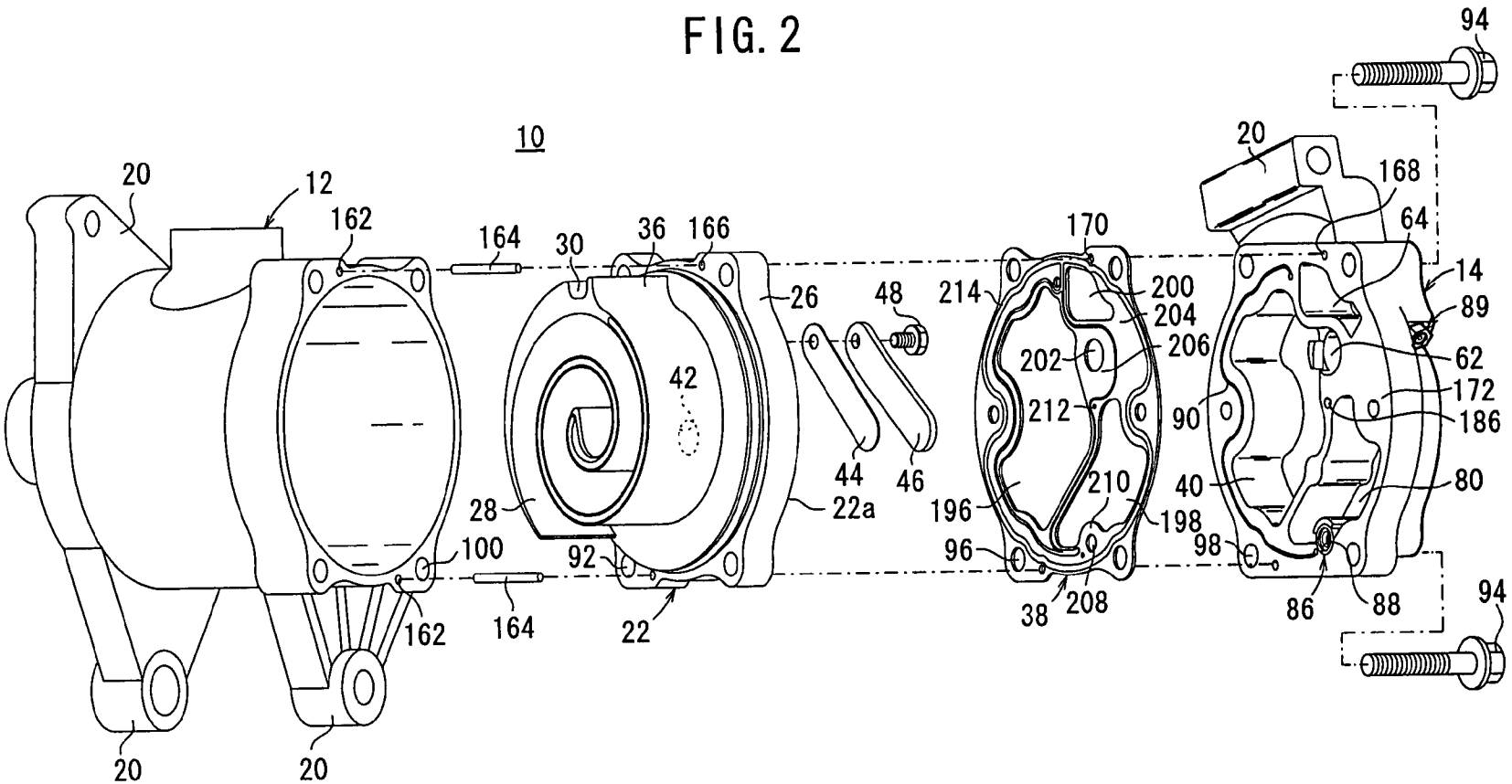
FIG. 2 is an exploded perspective view, partly omitted from illustration, of the scroll compressor shown in FIG. 1.
Figure 3:
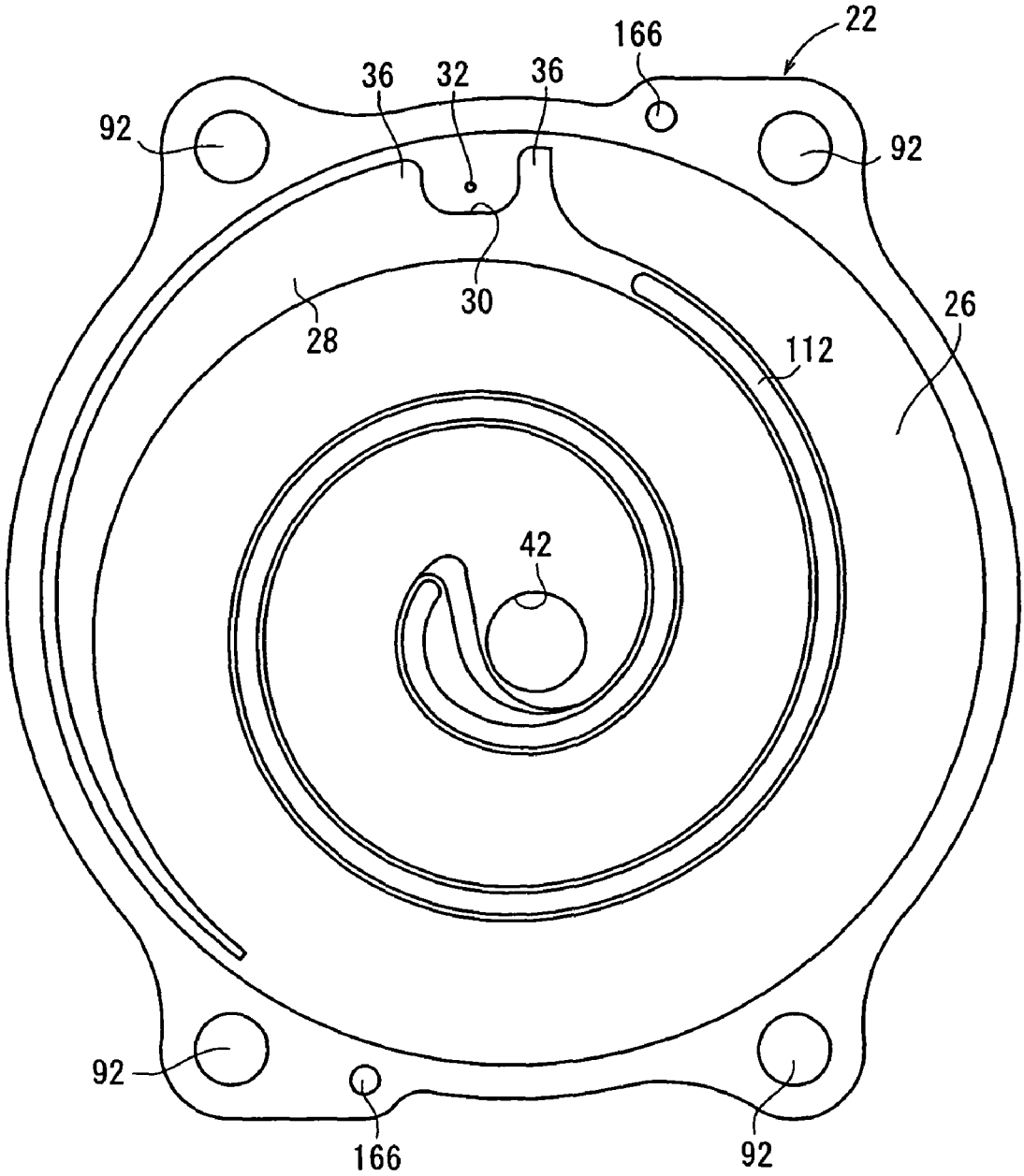
FIG. 3 is a plan view of a fixed scroll of scroll compressor shown in FIG. 2 as viewed from a fixed spiral wall.

As shown in FIGS. 2 and 3, the fixed spiral wall 28 has a wall thickness progressively greater radially from an outermost circumferential end toward an inner circumferential end. The fixed spiral wall 28 has a thickest portion in a vertically upward direction of the scroll compressor 10 (see FIG. 3). The fixed spiral wall 28 includes a guide passage (oil passage) 30 defined in the upper portion thereof and shaped as a radially inward recess.

Figure 4:
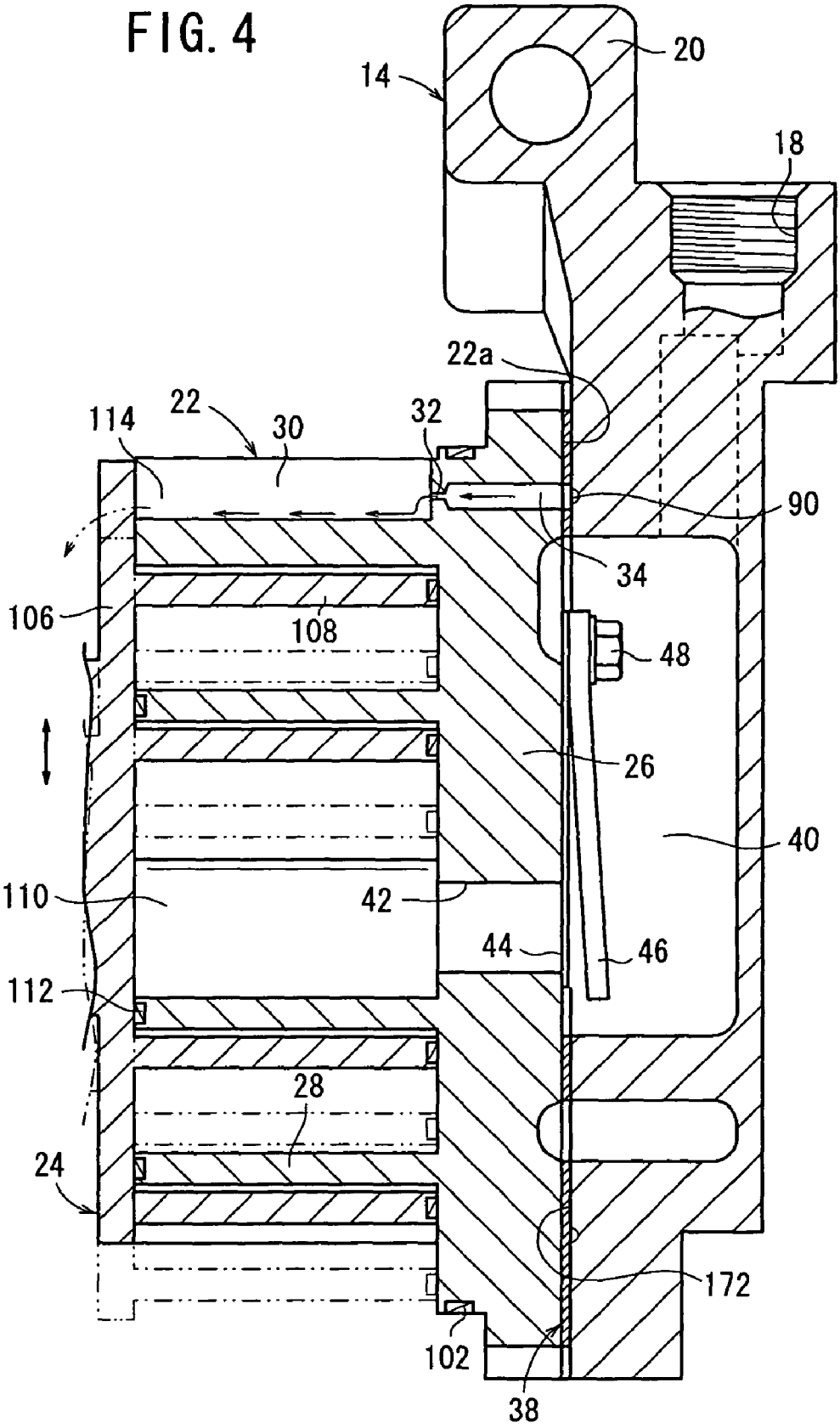
FIG. 4 is a vertical cross-sectional view of a movable scroll, the fixed scroll, a gasket, and a rear housing of the scroll compressor shown in FIG. 1.

The guide passage 30 is of a substantially rectangular cross-sectional shape and extends substantially parallel to the axis of the fixed scroll 22. The fixed base plate 26 has an oil supply hole 32 defined therein in confronting relation to the guide passage 30. The oil supply hole 32 is held in fluid communication with a supply passage (oil supply hole) 34 extending through the fixed base plate 26, and is held in fluid communication with a rear surface 22*a* of the fixed scroll 22 through the supply passage 34 (see FIG. 4). A pair of dam walls (walls) 36 is erected radially outwardly on respective both sides of the guide passage 30 (see FIG. 3). As with the guide passage 30, the supply passage 34 extends substantially parallel to the axis of the fixed scroll 22. When a lubricating oil is supplied from the rear housing 14 to the supply passage 34, the lubricating oil is discharged through the oil supply hole 32 into the guide passage 30 and is prevented by the dam walls 36 from flowing circumferentially along the fixed spiral wall 28. As a result, the lubricating oil flows straight along the guide passage 30.

As shown in FIGS. 1 and 2, the rear housing 14 is mounted on the rear surface 22*a* of the fixed base plate 26 of the fixed scroll 22 with a gasket 38 in the form of a thin plate being interposed therebetween. An outlet hole 42 is defined substantially centrally in the rear surface 22*a* in fluid communication between a compression chamber 110 and an outlet chamber 40 (to be described later) that is defined between the rear surface 22*a* and the rear housing 14.

On the rear surface 22*a* of the fixed scroll 22, there are mounted an outlet valve 44 for normally closing the outlet hole 42 and flexing to open the outlet hole 42 when a fluid compressed in the compression chamber 110 develops a predetermined pressure, and a retainer 46 for limiting the opening of the outlet valve 44. The outlet valve 44 has an end disposed at a position facing the outlet hole 42 and the other end fastened together with the retainer 46 by a bolt 48 that is spaced linearly a predetermined distance from the outlet hole 42 (see FIGS. 5 and 6). When the outlet valve 44 that is seated to close the outlet hole 42 is unseated from the outlet hole 42 under the pressure of the compressed fluid introduced into the outlet hole 42, the fluid is supplied through the outlet hole 42 into the outlet chamber 40.

The retainer 46 is inclined from its end fastened by the bolt 48 through a predetermined angle in a direction away from the rear surface 22*a* of the fixed scroll 22. Therefore, when the outlet valve 44 is opened by the compressed fluid delivered through the outlet hole 42, the outlet valve 44 has its valve opening limited by abutting engagement with the retainer 46.

Figure 5:
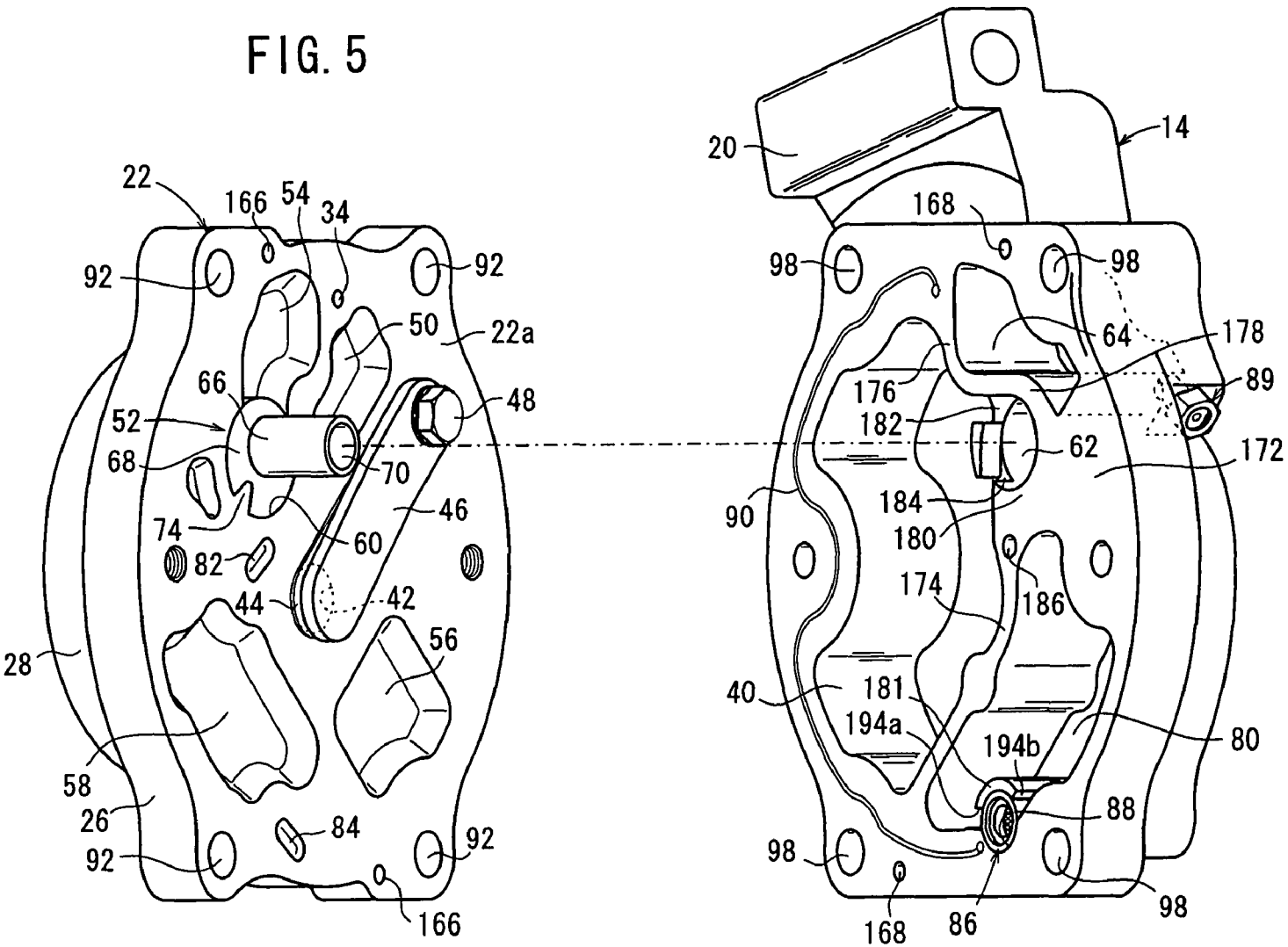
FIG. 5 is an exploded perspective view of the fixed scroll and the rear housing shown in FIG. 1 as they are split apart along their mating surfaces.
Figure 6:
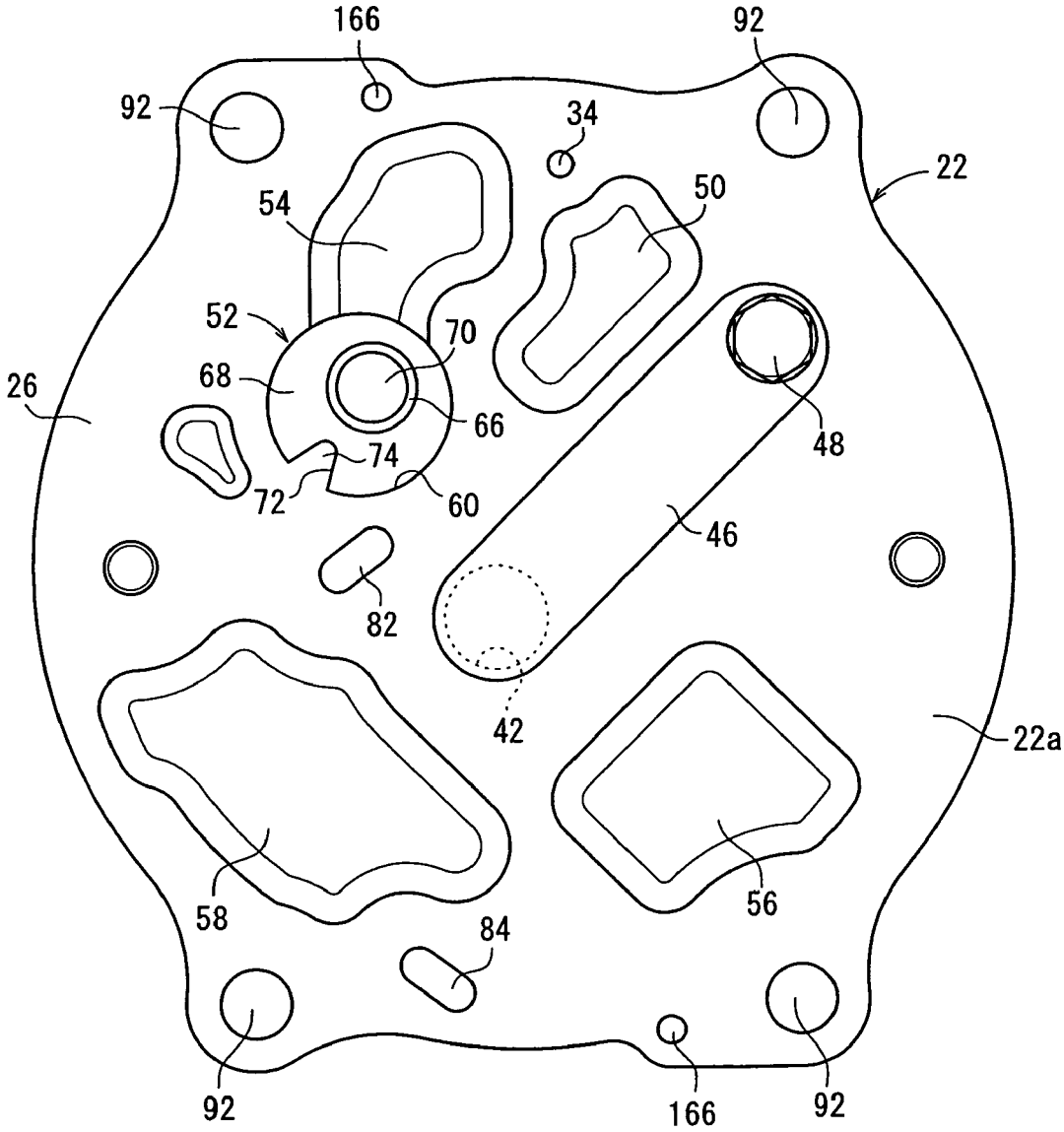
FIG. 6 is a plan view of a rear surface of the fixed scroll on which the gasket is to be mounted.

As shown in FIGS. 5 and 6, the supply passage 34 that is open at the rear surface 22*a* is defined in an upper portion of the rear surface 22*a*, and is substantially linearly spaced radially outwardly from the outlet hole 42 (see FIG. 6). The rear surface 22*a* has a first recess 50 defined therein between the outlet hole 42 and the supply passage 34 and having a predetermined depth, a second recess 54 defined therein adjacent to the first recess 50 and having an oil separation pipe 52 disposed therein, and third and fourth recesses 56, 58 defined in a lower portion of the rear surface 22*a*. The first through fourth recesses 50, 54, 56, 58 have substantially the same depth from the rear surface 22*a*.

The first recess 50 extends substantially parallel to the outlet valve 44 and the retainer 46, and is at a position facing the outlet chamber 40 in the rear housing 14.

The second recess 54 is disposed at a position that is substantially symmetrical relation to the first recess 50 with respect to a vertical straight line passing through the center of the outlet hole 42. The second recess 54 extends vertically in the rear surface 22*a* and faces a separation chamber 62 and a discharge chamber 64 (to be described later) in the rear housing 14. The oil separation pipe 52 is mounted in a circular recess 60, which is substantially circular in shape, defined in an end of the second recess 54 which is closer to the outlet hole 42 (see FIG. 7). The second recess 54 has a depth D2 that is a slight distance greater than the depth D1 of the circular recess 60 (D2>D1) (see FIG. 8).

Figure 7:
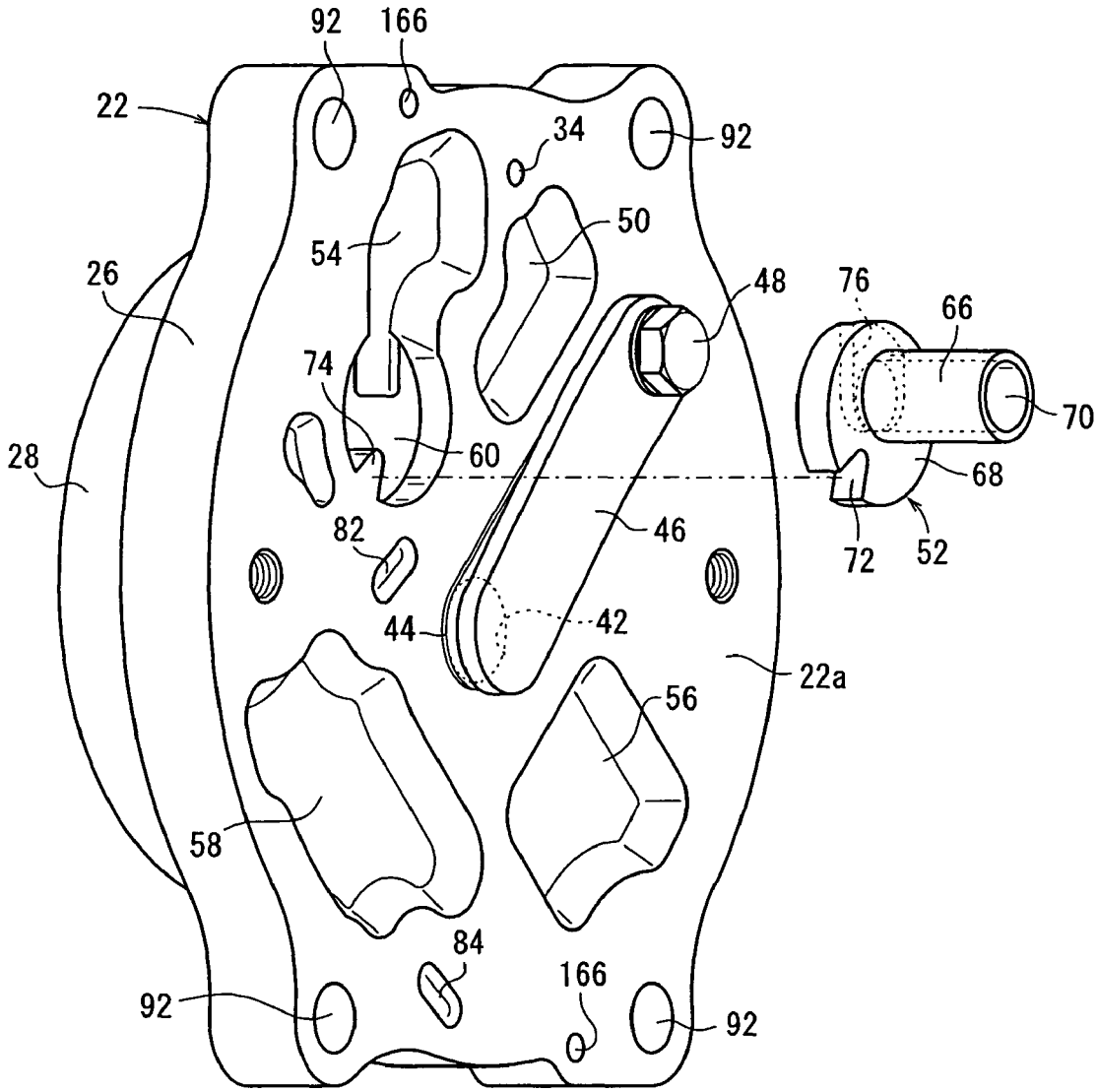
FIG. 7 is an exploded perspective view showing an oil separation pipe detached from the rear surface of the fixed scroll shown in FIG. 6.
Figure 8:
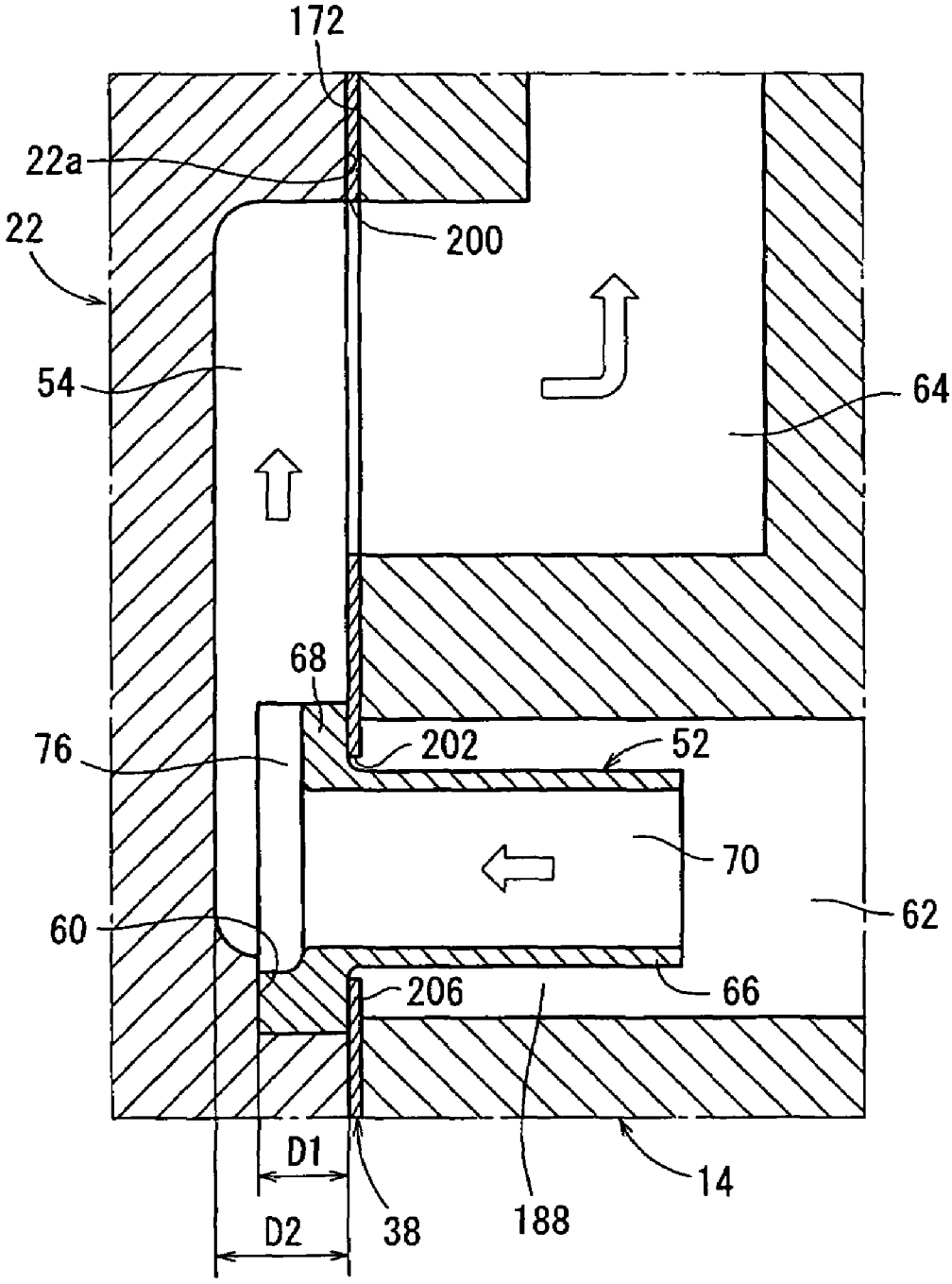
FIG. 8 is a vertical cross-sectional view showing the oil separation pipe mounted in a circular recess in the fixed scroll and sandwiched between the fixed scroll and the rear housing with the gasket interposed therebetween.

As shown in FIGS. 6 and 7, the oil separation pipe 52 includes a hollow cylindrical tube 66 and a disk-shaped flange 68 disposed on an end of the tube 66 and extending radially outwardly. The tube 66 is displaced radially off the center of the disk-shaped flange 68. The tube 66 and the flange 68 have a passage 70 defined axially therethrough.

The flange 68 has an engaging groove 72 of substantially triangular cross section defined therein and extending radially inwardly from a circumferential surface thereof. When the oil separation pipe 52 is mounted in the circular recess 60, the engaging groove 72 engages an engaging ridge 74 disposed in the circular recess 60, thereby positioning the oil separation pipe 52 with respect to the fixed scroll 22 and preventing the flange 68 from rotating in the circular recess 60. Stated otherwise, the engaging ridge 74 disposed in the circular recess 60 functions as a rotation stopper for the oil separation pipe 52.

The flange 68 also has a groove 76 defined in a surface thereof which faces the circular recess 60 and being concave toward the tube 66. When the flange 68 is mounted in the circular recess 60, the groove 76 faces the second recess 54 (see FIG. 8). In other words, the passage 70 in the oil separation pipe 52 and the second recess 54 are held in fluid communication with each other through the groove 76.

The gasket 38 abuts against the rear surface 22*a* of the fixed scroll 22 and the rear housing 14 abuts against the gasket 38, whereby the oil separation pipe 52 is held and gripped between the fixed scroll 22 and the rear housing 14 while the flange 68 being inserted in the circular recess 60.

Figure 9:
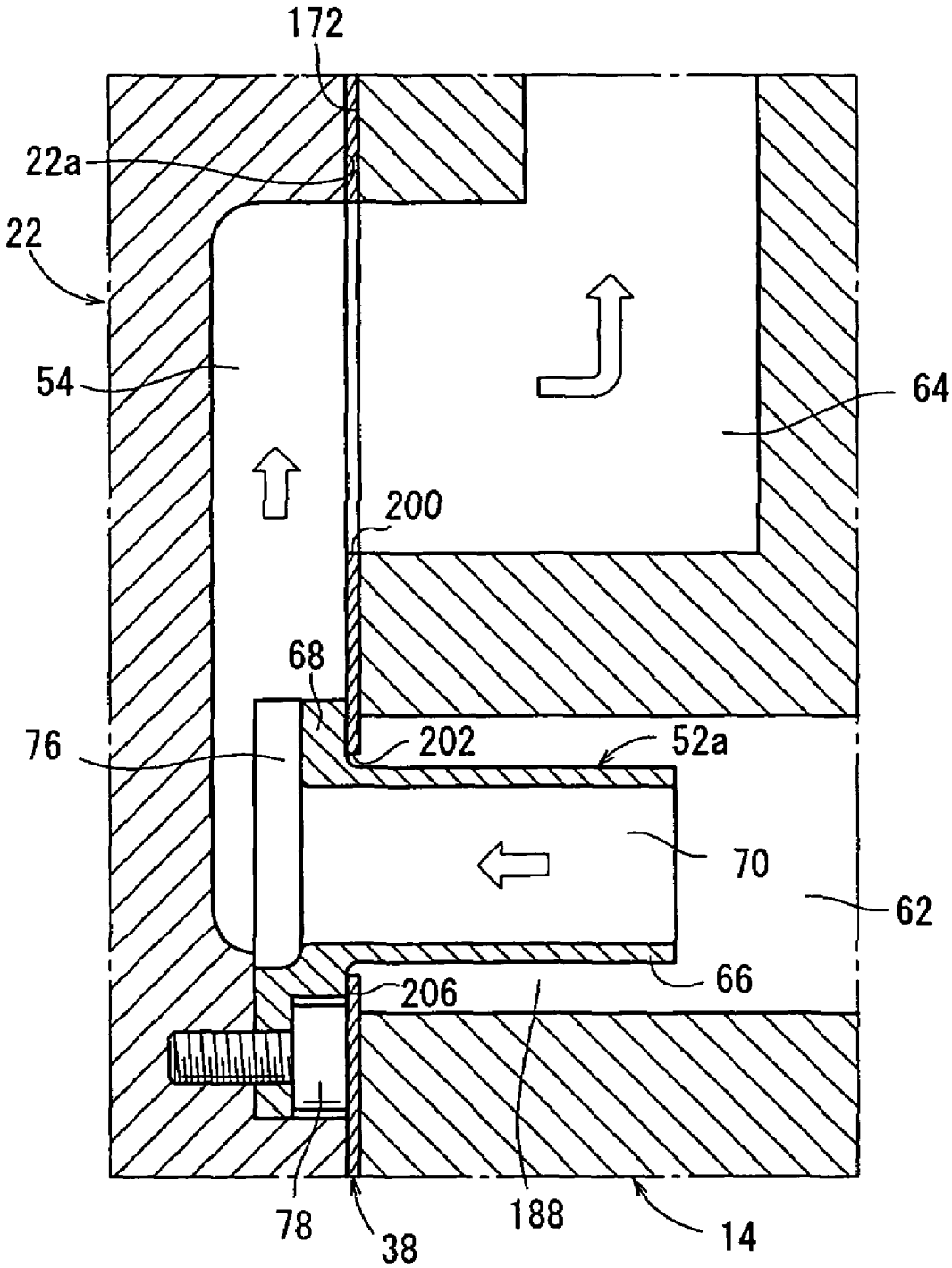
FIG. 9 is a vertical cross-sectional view showing a modified oil separation pipe fastened to the fixed scroll by a fastening bolt.

Rather than providing the engaging groove 72 of the oil separation pipe 52 and the engaging ridge 74 of the circular recess 60, a flange 68 of an oil separation pipe 52*a*, as shown in FIG. 9, may be fastened with respect to the circular recess 60 by a fastening bolt 78. Thus, the oil separation pipe 52 is held as being positioned with respect to the fixed scroll 22, and is more firmly and reliably secured in position under gripping forces from the fastening bolt 78 and gripping forces from the fixed scroll 22 and the rear housing 14.

As shown in FIG. 6, the third recess 56 is disposed at a position that is substantially symmetrical relation to the second recess 54 with respect to the outlet hole 42, and at a position facing the outlet chamber 40 in the rear housing 14, as with the first recess 50.

The fourth recess 58 is disposed at a position linearly aligned with the outlet valve 44 and the retainer 46, and at a position facing an oil storage chamber 80 (to be described later) in the rear housing 14.

A first communication passage 82 is defined between the fourth recess 58 and the circular recess 60 of the second recess 54 substantially parallel to the outlet valve 44 and the retainer 46. The first communication passage 82 has a predetermined depth from the rear surface 22*a* and extends substantially linearly. When the fixed scroll 22 is assembled on the rear housing 14, an end of the first communication passage 82 faces an outlet passage 186 that is held in fluid communication with the separation chamber 62 in the rear housing 14, and the other end of the first communication passage 82 faces the oil storage chamber 80.

A second communication passage 84 is defined below the fourth recess 58 in a direction substantially perpendicular to the axis of the outlet valve 44 and the retainer 46. The second communication passage 84 has substantially the same depth as the first communication passage 82 and extends substantially linearly. When the fixed scroll 22 is assembled on the rear housing 14, an end of the second communication passage 84 faces a filter chamber 88 (to be described later) in which a filter 86 is mounted, and the other end of the second communication passage 84 faces an end of an oil supply groove 90 (to be described later) defined in the rear housing 14. In other words, the filter chamber 88 and the oil supply groove 90 are held in fluid communication with each other through the second communication passage 84.

A plurality of (e.g., four) first bolt holes 92 are defined in an outer peripheral edge portion of the fixed scroll 22 at spaced intervals therebetween, and a plurality of (e.g., four) bolts 94 are inserted through the respective first bolt holes 92. The bolts 94 are threaded through second bolt holes 96 in the gasket 38 and third bolt holes 98 in the rear housing 14 into screw holes 100 in the front housing 12, thereby integrally coupling the fixed scroll 22 to the rear housing 14 and the front housing 12. An O-ring 102 is mounted in an annular groove defined in the fixed base plate 26 of the fixed scroll 22, thereby hermetically sealing a suction chamber 104 that is defined by the fixed scroll 22 and the front housing 12 (see FIG. 1).

As shown in FIG. 1, the movable scroll 24 comprises a movable base plate 106 and a movable spiral wall 108 erected in a spiral shape from the movable base plate 106 toward the fixed scroll 22, the movable spiral wall 108 interleaving the fixed spiral wall 28.

The fixed base plate 26 and the fixed spiral wall 28 of the fixed scroll 22 and the movable base plate 106 and the movable spiral wall 108 of the movable scroll 24 define the compression chamber 110 therebetween.

Seal members 112 are mounted on respective ends of the fixed spiral wall 28 and the movable spiral wall 108 in slidable contact with the movable base plate 106 and the fixed base plate 26, respectively, thereby sealing the compression chamber 110.

The movable base plate 106 abuts against the fixed spiral wall 28 to close the end of the guide passage 30 of the fixed scroll 22 by the movable base plate 106. Thus, the guide passage 30, as it is surrounded by the movable base plate 106 and the dam walls 36, functions as an oil storage reservoir 114 for storing a predetermined amount of lubricating oil (see FIG. 4).

A shank 118 on an end of a rotational shaft 116 is inserted in the other end of the front housing 12. The shank 118 is rotatably supported by a first bearing 120 held in the other end of the front housing 12. A sealing member 122 for sealing the suction chamber 104 is fitted over the shank 118 of the rotational shaft 116. The sealing member 122 is supported by a shoulder of an opening in the front housing 12, and comprises a ring-shaped core made of a metal material and coated with a rubber-based material or a resin-based material.

A support 124 is disposed on the other end of the rotational shaft 116. The support 124 has a diameter greater than the first-mentioned end of the rotational shaft 116. The support 124 is rotatably supported by a second bearing 126 held in the front housing 12, the support 124 having an outer circumferential surface fitted in the second bearing 126. Therefore, the rotational shaft 116 is rotatably supported by the first and second bearings 120, 126. A pin 128 displaced off the axis of the support 124 is fixed to the support 124.

The movable base plate 106 of the movable scroll 24 has a mount hole 130 defined therein which is open toward the second bearing 126. A bushing 134 is rotatably supported in the mount hole 130 by an orbital bearing 132. The bushing 134 has a hole 136 defined therein which is displaced off the axis of the bushing 134, and the pin 128 of the support 124 is inserted in the hole 136.

The pin 128 has an annular groove defined in a distal end thereof, and a retaining ring 138 is fitted in the annular groove. The pin 128 is prevented from being axially moved with respect to the bushing 134 by the retaining ring 138 mounted in the annular groove. A disk-shaped balancer weight 140 is mounted on the bushing 134 near its proximal end.

In the front housing 12, there are disposed a thrust plate 142 having a sliding portion by which the movable scroll 24 is slidably supported, and an Oldham ring 144 for preventing the movable scroll 24 from rotating about its own axis and allowing the movable scroll 24 to make orbiting movement.

The front housing 12 also houses therein an Oldham base 146 by which the Oldham ring 144 is supported for reciprocating movement in a direction perpendicular to the axis of the rotational shaft 116, and which bears, through the thrust plate 142, a thrust force that is applied to the movable scroll 24 along the axis of the rotational shaft 116.

The movable base plate 106 of the movable scroll 24 has a pair of engaging recesses 148 defined in a front surface thereof for allowing the movable scroll 24 to be reciprocally displaced only radially. A pair of first engaging teeth 150 projecting radially of the Oldham ring 144 slidably engages in the engaging recesses 148.

For allowing the movable scroll 24 to be reciprocally displaced only in directions perpendicular to the first engaging recesses 148, the Oldham ring 144 has a pair of second engaging teeth (not shown) projecting radially perpendicularly to the first engaging teeth 150. The second engaging teeth slidably engage in a pair of second engaging recesses, not shown, projecting radially of the Oldham base 146.

The Oldham base 146 is fastened to the front housing 12 by a plurality of (e.g., two) bolts 154 with a shim 152 interposed between the Oldham base 146 and the front housing 12. The shim 152 is mounted in place for the purpose of adjusting an axial gap between the fixed scroll 22 and the movable scroll 24 to a predetermined value. If the gap is appropriately adjusted, then the shim 152 may not be mounted in place.

A pulley 158 is mounted on an outer circumferential surface of the other end of the front housing 12 by a third bearing 156. Rotational power is transmitted from a rotary drive source such as an engine or the like, not shown, to the pulley 158. The rotational power is selectively transmitted or not transmitted to the rotational shaft 116 when an electromagnetic clutch 160 disposed in the pulley 158 is turned on or off.

As shown in FIG. 2, the front housing 12 has a pair of first positioning holes 162 defined in an end face thereof and diagonally spaced a predetermined distance from each other. A pair of positioning pins 164 is inserted and secured in certain axial positions in the first positioning holes 162. The positioning pins 164 function as a positioning reference for assembling the front housing 12, the fixed scroll 22, the gasket 38, and the rear housing 14.

In alignment with the positioning pins 164, the fixed scroll 22 has a pair of second positioning holes 166 defined therethrough, the rear housing 14 has a pair of third positioning holes 168 defined therein, and the gasket 38 has a pair of fourth positioning holes 170 defined therethrough.

The positioning pins 164 may be inserted in the second positioning holes 166 defined through the fixed scroll 22 in advance, or may be fitted and secured in the third positioning holes 168 in the rear housing 14 in advance.

As shown in FIG. 1, the rear housing 14 is coupled to the front housing 12 with the fixed scroll 22 and the gasket 38 interposed therebetween. The gasket 38 is sandwiched between the rear housing 14 and the fixed scroll 22.

Figure 10:
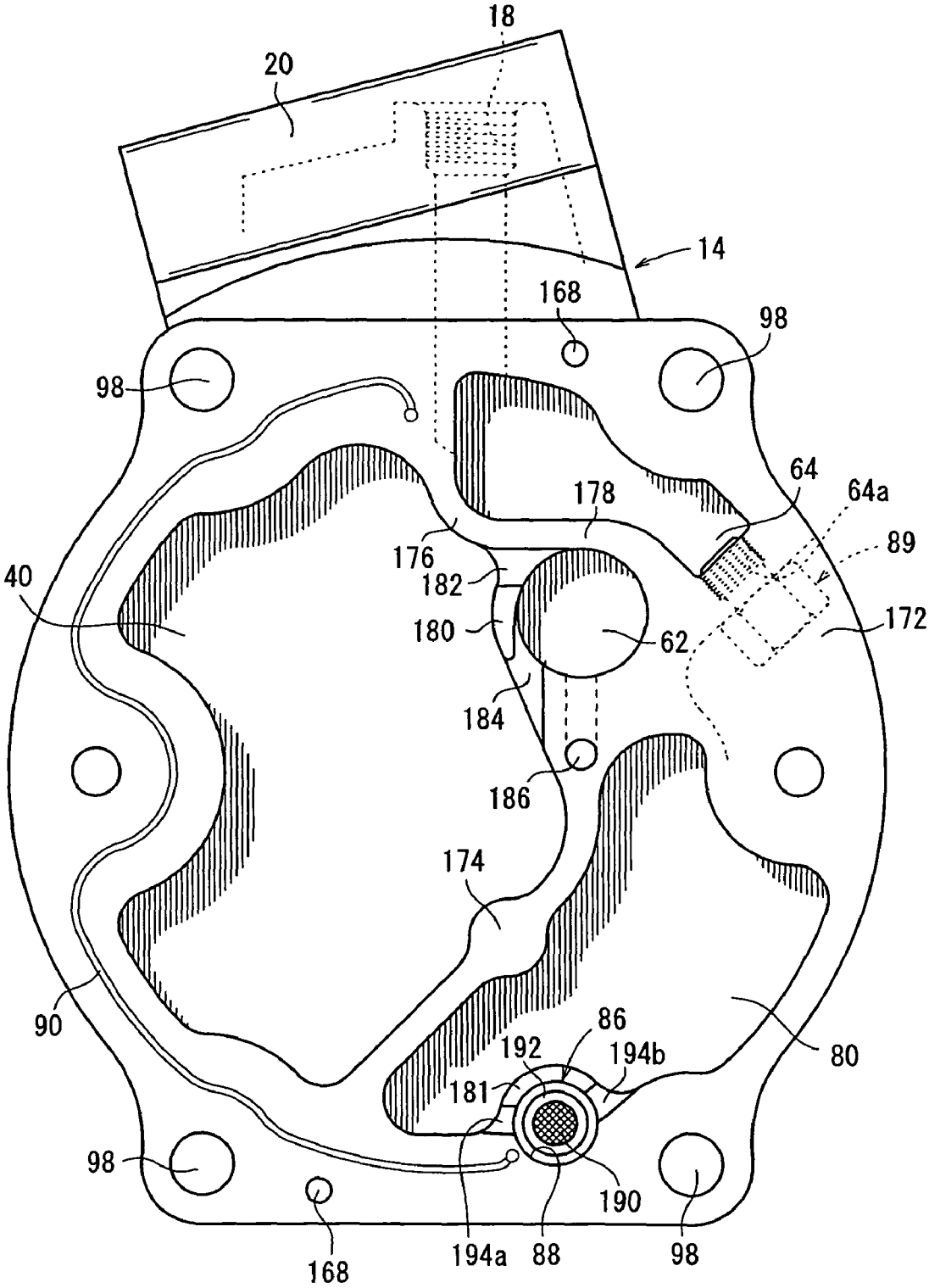
FIG. 10 is a plan view of the rear housing as viewed from the mating surface on which the gasket is to be mounted.

As shown in FIGS. 5 and 10, the rear housing 14 includes the outlet chamber 40 into which the fluid compressed in the compression chamber 110 is introduced, the separation chamber 62 held in fluid communication with the outlet chamber 40 for separating the lubricating oil contained in the fluid, the oil storage chamber 80 for storing the separated lubricating oil, and the discharge chamber 64 into which the fluid is introduced after the lubricating oil has been separated from the fluid, these chambers being open in a mating surface 172 of the rear housing 14 that is held in abutment against the gasket 38.

The outlet chamber 40 and the oil storage chamber 80 are separated from each other by a first boundary wall 174, the outlet chamber 40 and the discharge chamber 64 by a second boundary wall 176, and the oil storage chamber 80 and the discharge chamber 64 by a third boundary wall 178. The separation chamber 62 is separated from the outlet chamber 40, the oil storage chamber 80, and the discharge chamber 64 by an annular wall 180 extending around the separation chamber 62.

Figure 11:
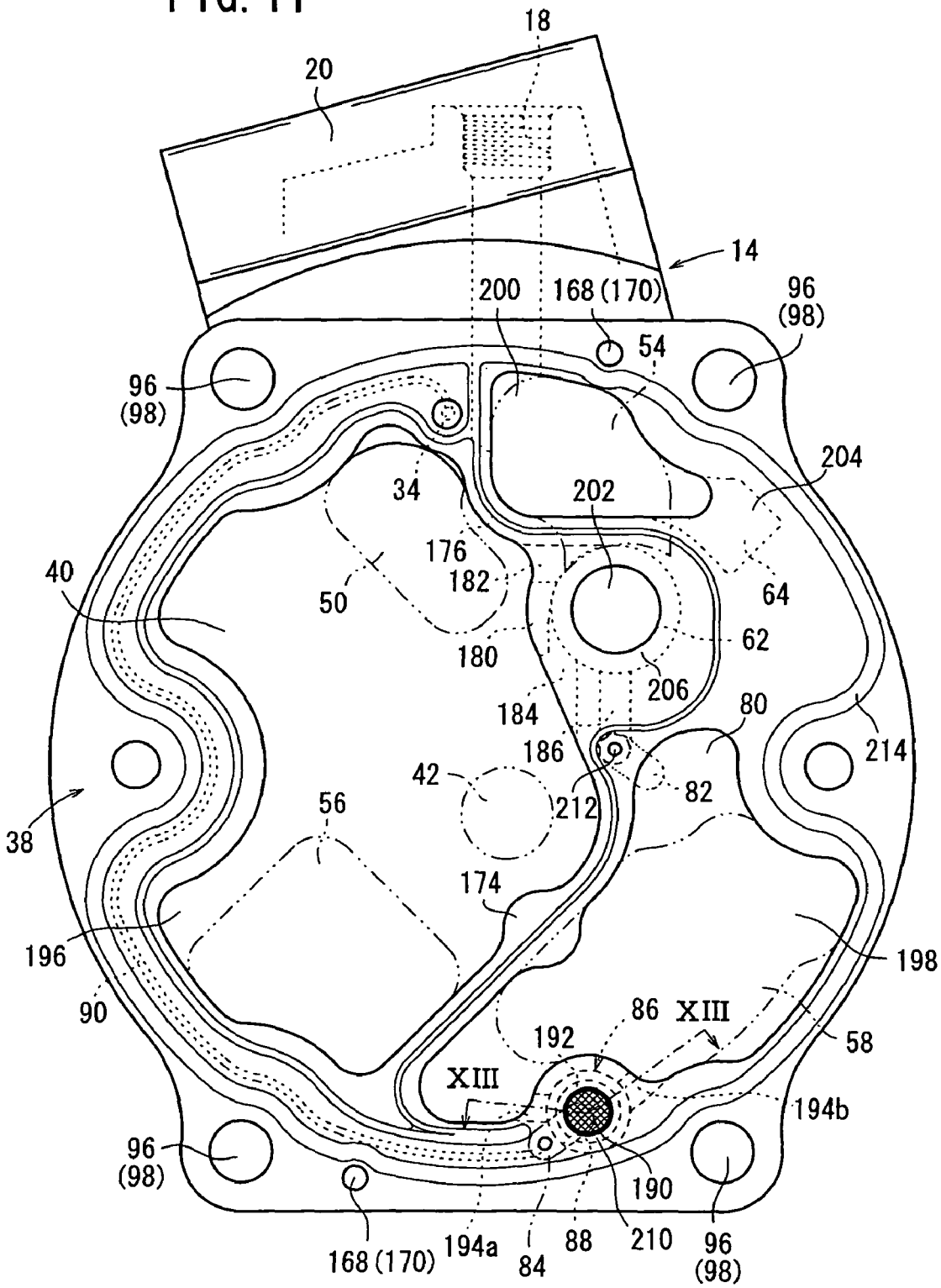
FIG. 11 is a plan view showing the gasket mounted on the mating surface of the rear housing, and first through fourth recesses and an outlet hole of the fixed scroll which are positioned over the mating surface of the rear housing.

As shown in FIG. 11, when the fixed scroll 22 is assembled on the rear housing 14, the outlet chamber 40 are positioned to face the outlet hole 42 and the first and third recesses 50, 56 in the fixed scroll 22, and is concave to a predetermined depth along the axial direction of the rear housing 14. The outlet chamber 40 is of a size which is about one-half the surface area of the mating surface 172 of the rear housing 14. The outlet valve 44 and the retainer 46 that are mounted on the fixed scroll 22 are inserted in the outlet chamber 40.

The separation chamber 62 is disposed adjacent to the outlet chamber 40 and the discharge chamber 64 with the annular wall 180 interposed therebetween. When the fixed scroll 22 is assembled on the rear housing 14, the separation chamber 62 is positioned to face the oil separation pipe 52 (see FIG. 12). As shown in FIGS. 10 and 11, the separation chamber 62 is of a substantially circular cross-sectional shape and has a predetermined depth along the axial direction of the rear housing 14. First and second inlet passages 182, 184 are defined in the annular wall 180 between the separation chamber 62 and the outlet chamber 40 by cutting portions out of the annular wall 180, so that the fluid in the outlet chamber 40 will be introduced through the first and second inlet passages 182, 184 into the separation chamber 62. The first and second inlet passages 182, 184 extend substantially perpendicularly to each other and are spaced a predetermined distance from each other. The first and second inlet passages 182, 184 extend tangentially to the inner circumferential surface of the separation chamber 62. Therefore, the fluid introduced from the first and second inlet passages 182, 184 into the separation chamber 62 flows in the separation chamber 62 as a swirling flow along the inner circumferential surface of the separation chamber 62.

Figure 12:
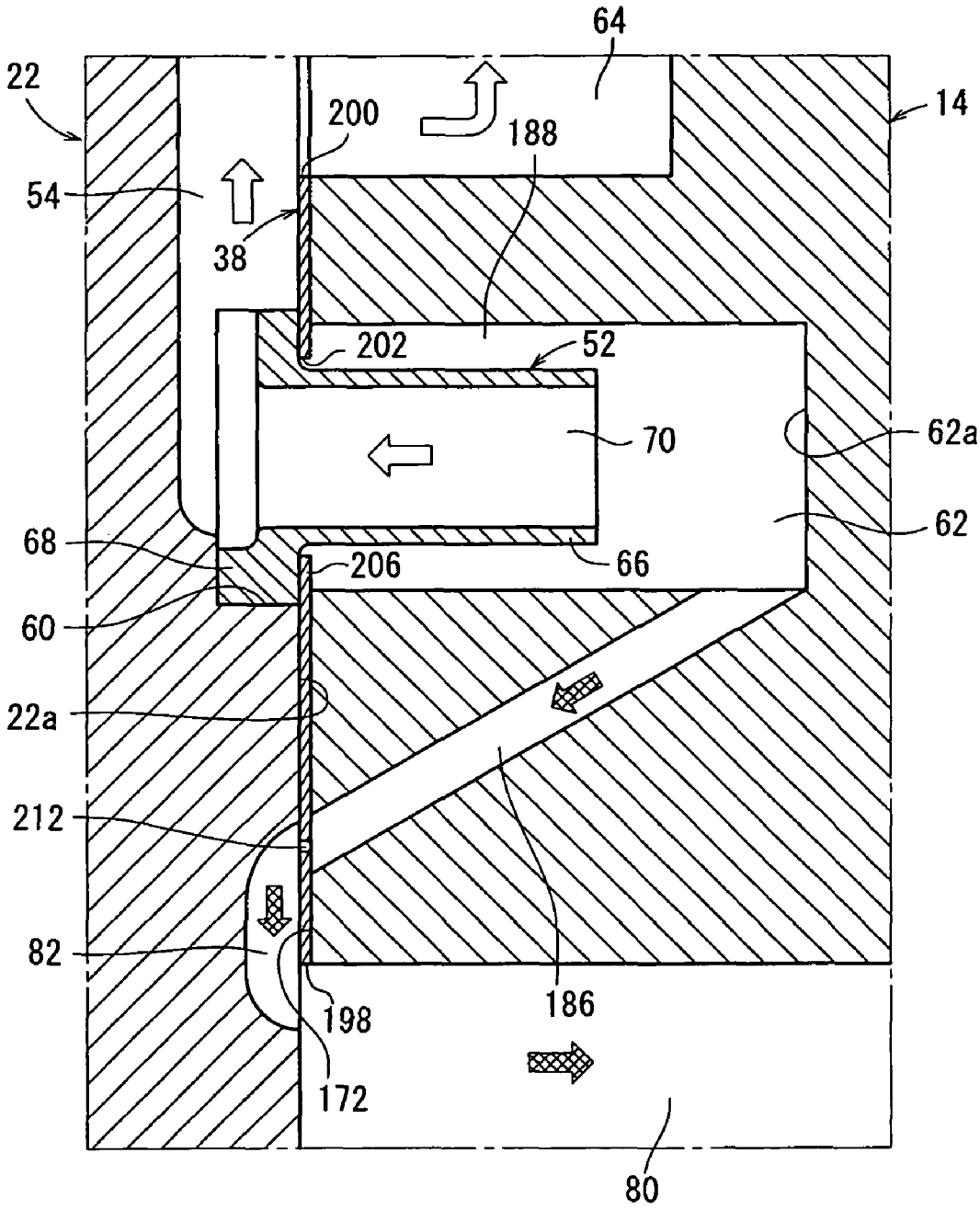
FIG. 12 is a vertical cross-sectional view showing the relationship between a separation chamber, an outlet passage, and a restriction hole in the gasket, in the fixed scroll, the gasket, and the rear housing that are assembled together.

As shown in FIG. 12, an outlet passage 186 is defined so as to face a bottom 62*a* of the separation chamber 62 remotely from the opening thereof at the mating surface 172. The outlet passage 186 is inclined a predetermined angle to the axis of the separation chamber 62 and extends to the mating surface 172. Specifically, the outlet passage 186 has an end connected to a boundary region between the bottom 62*a* and an inner circumferential surface of the separation chamber 62 which is vertically beneath the bottom 62*a*, and extends obliquely downwardly at a predetermined angle from the bottom 62*a*. The other end of the outlet passage 186 is open at the first boundary wall 174 of the mating surface 172 (see FIG. 10).

Accordingly, the interior of the separation chamber 62 and the mating surface 172 are held in fluid communication with each other through the outlet passage 186. The outlet passage 186 is connected to the first boundary wall 174 near the junction between the first boundary wall 174 and the annular wall 180.

As shown in FIGS. 11 and 12, the first communication passage 82 in the fixed scroll 22 has an end facing the outlet passage 186 and the other end facing the oil storage chamber 80.

The tube 66 of the oil separation pipe 52 mounted on the fixed scroll 22 is inserted in the separation chamber 62, and a clearance 188 providing a certain gap is defined between the tube 66 and the inner circumferential surface of the separation chamber 62. When the fluid is introduced from the outlet chamber 40 into the separation chamber 62, the fluid flows through the clearance 188 toward the bottom 62*a*, then flows through the passage 70 in the tube 66 to the flange 68 of the oil separation pipe 52, and is discharged through the groove 76 in the oil separation pipe 52 into the second recess 54.

The oil storage chamber 80 is disposed in a lower portion of the rear housing 14, and is positioned to face the fourth recess 58 in the fixed scroll 22 when the fixed scroll 22 is assembled on the rear housing 14.

Figure 13:
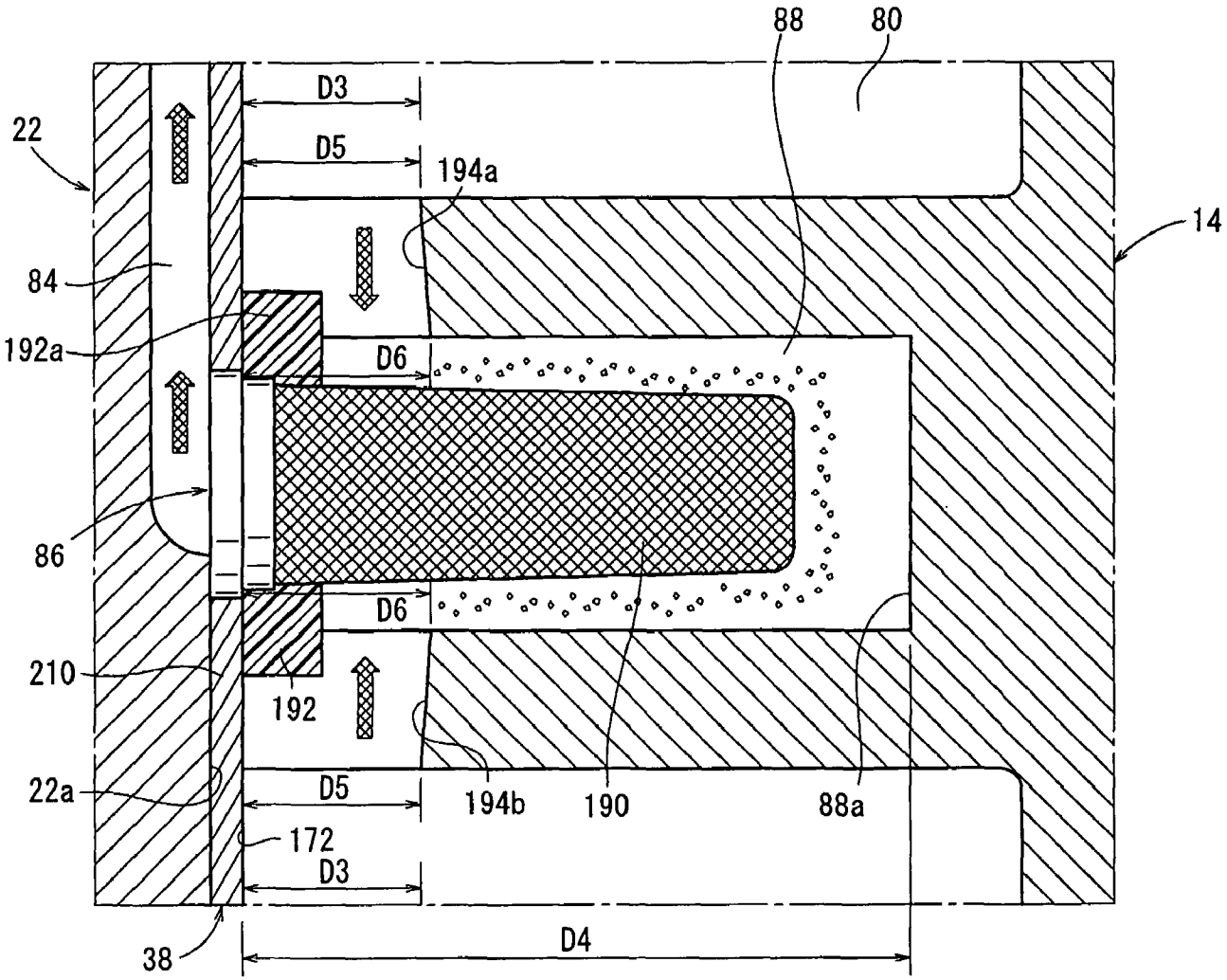
FIG. 13 is a cross-sectional view taken along line XIII-XIII of FIG. 11.

As shown in FIG. 13, the filter chamber 88 for mounting therein the filter 86 for removing dust, etc. in the lubricating oil is disposed below the oil storage chamber 80, and is of a bottomed shape having a predetermined depth along the axial direction. The filter chamber 88 is defined independently of the oil storage chamber 80.

The filter 86 is of a hollow cylindrical shape and includes a filter element 190 comprising a mesh screen and a holder case 192 for holding and mounting the filter element 190 in the filter chamber 88. As shown in FIG. 10, when the lubricating oil is introduced into the filter chamber 88 through a pair of third and fourth inlet passages 194*a*, 194*b* defined between the filter chamber 88 and the oil storage chamber 80, the lubricating oil passes through the filter element 190 from its outer circumferential surface to its inner circumferential surface. At this time, the filter element 190 removes dust (e.g., iron particles) contained in the lubricating oil, and the removed dust is held in the bottomed filter chamber 88.

As shown in FIG. 13, the third and fourth inlet passages 194*a*, 194*b* have a depth D3 smaller than the axial depth D4 of the filter chamber 88 (D3<D4). The depth D5 of the third and fourth inlet passages 194*a*, 194*b* along the oil storage chamber 80 is smaller than the depth D6 of the third and fourth inlet passages 194*a*, 194*b* along the filter chamber 88. Thus, dust, etc. that has entered the filter chamber 88 is prevented from flowing back into the oil storage chamber 80 through the third and fourth inlet passages 194*a*, 194*b*. Since the depth of the third and fourth inlet passages 194*a*, 194*b* is greater along the filter chamber 88 than along the oil storage chamber 80, dust, etc. in the third and fourth inlet passages 194*a*, 194*b* is guided into the filter chamber 88 and hence can appropriately be collected in the filter chamber 88.

As shown in FIG. 10, the discharge chamber 64 has a valve hole 64*a* defined in an inner wall surface thereof in fluid communication with the external space. An open valve 89 for discharging the fluid out of the discharge chamber 64 is mounted in the valve hole 64*a*. The open valve 89 has a valve body (not shown) disposed therein. When the pressure of the fluid in the discharge chamber 64 reaches a predetermined level or higher, the valve body is opened to discharge the fluid out of the discharge chamber 64 through the open valve 89.

As the pressure in the discharge chamber 64 is lowered to a desired pressure level, the valve body is closed again, cutting the fluid communication between the discharge chamber 64 and the external space to hold the pressure in the discharge chamber 64 at the desired pressure level. Therefore, the open valve 89 functions as a safety valve for preventing the pressure in the discharge chamber 64 from becoming excessively high.

As shown in FIG. 10, the oil supply groove 90 is defined in the mating surface 172 of the rear housing 14. The oil supply groove 90 extends from a position near the filter chamber 88 with the filter 86 mounted therein along an outer circumferential region of the outlet chamber 40 in the mating surface 172 to a position near an end of the second boundary wall 176 between the outlet chamber 40 and the discharge chamber 64. The oil supply groove 90 is concave to a predetermined depth from the mating surface 172.

As shown in FIG. 11, when the fixed scroll 22 is assembled on the rear housing 14, the oil supply groove 90 has an end facing an end of the second communication passage 84 defined in the rear surface 22*a* of the fixed scroll 22 and the other end facing the supply passage 34.

Since the second communication passage 84 is connected so as to face the center of the filter chamber 88 and the oil supply groove 90, the lubricating oil from which dust is removed in the filter chamber 88 flows from the second communication passage 84 into the oil supply groove 90 and is supplied from the supply passage 34 to the oil supply hole 32.

Figure 14:
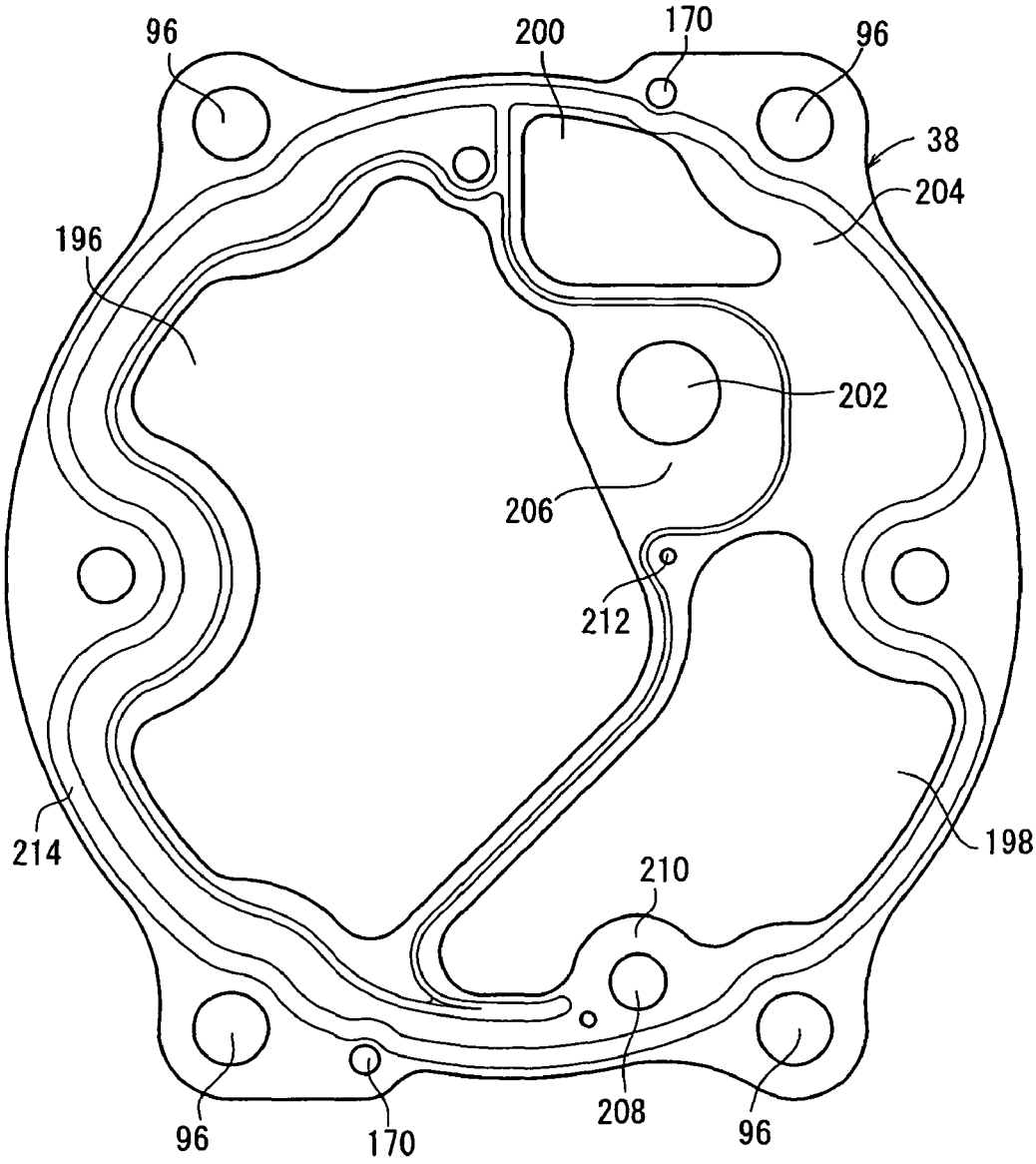
FIG. 14 is a plan view of the gasket as viewed from the fixed scroll.

As shown in FIGS. 11 and 14, the gasket 38 is of a shape corresponding to the rear surface 22*a* of the fixed scroll 22 and the mating surface 172 of the rear housing 14, and is in the form of a thin plate having a substantially constant thickness.

The gasket 38, as it abuts against the mating surface 172 of the rear housing 14, has an outlet opening 196 having substantially the same shape as the outlet chamber 40, an oil storage opening 198 having substantially the same shape as the oil storage chamber 80, a discharge opening 200 defined at a position facing the discharge chamber 64, and a separation opening 202 defined at a position facing the separation chamber 62 and closing a portion of the separation chamber 62.

A first partition wall 204 which closes a portion of the discharge chamber 64 is disposed adjacent to the discharge opening 200.

The separation opening 202 is shaped such that the tube 66 of the oil separation pipe 52 is inserted therethrough. A second partition wall 206 which closes the portion of the separation chamber 62 outside of the tube 66 is disposed adjacent to the separation opening 202. The separation opening 202 has a diameter which is substantially the same as the outside diameter of the tube 66. Consequently, after the tube 66 is inserted in the separation opening 202, the separation chamber 62 is closed by the second partition wall 206.

The gasket 38 has a filter opening 208 defined at a position facing the filter chamber 88, the filter opening 208 being open in facing relation to the center of the filter 86. A third partition wall 210 which closes a portion of the filter chamber 88 is disposed around the filter opening 208. The third partition wall 210 is disposed in abutment against an end face of the holder case 192 of the filter 86.

A restriction hole 212 is defined between the outlet opening 196 and the oil storage opening 198 at a position facing the outlet passage 186 in the rear housing 14. The restriction hole 212 has a diameter smaller than the outlet passage 186. Thus, the outlet passage 186 is held in fluid communication with the first communication passage 82 through the restriction hole 212 (see FIG. 12). The restriction hole 212 is formed by punching the gasket 38, for example, and has a diameter set to a desired value depending on a desired amount of fluid flowing through the restriction hole 212.

As shown in FIG. 14, the gasket 38 has second bolt holes 96 defined in an outer circumferential portion thereof in facing relation to the first bolt holes 92 in the fixed scroll 22 and the third bolt holes 98 in the rear housing 14. An annular bead 214 is disposed radially inwardly with respect to the second bolt holes 96 and extends along an outer circumferential edge of the gasket 38. The bead 214 bulges slightly in the axial direction of the gasket 38 and is disposed in facing relation to the inner circumferential portion of the oil supply groove 90, the first and second boundary walls 174, 176, and the annular wall 180 of the rear housing 14. When the gasket 38 is sandwiched between the fixed scroll 22 and the rear housing 14, the bead 214 is reliably held in abutment against the fixed scroll 22 and the rear housing 14 for sealing them effectively.

The scroll compressor 10 according to the present embodiment is basically constructed as described above. A process of assembling the fixed scroll 22, the gasket 38, and the rear housing 14 will be described below.

First, the outlet valve 44 and the retainer 46 are mounted on the rear surface 22*a* of the fixed scroll 22 which interleaves the movable scroll 24, and the flange 68 of the oil separation pipe 52 is mounted in the circular recess 60 (see FIG. 5). Then, the gasket 38 is mounted on the rear surface 22*a* of the fixed scroll 22 such that the tube 66 of the oil separation pipe 52 is inserted in the separation opening 202 in the gasket 38.

At this time, as shown in FIG. 11, the outlet opening 196 of the gasket 38 faces the outlet hole 42 and the first and third recesses 50, 56 in the fixed scroll 22, and the outlet valve 44 and the retainer 46 are inserted in the outlet opening 196. The discharge opening 200 faces the second recess 54, and the oil storage opening 198 faces the fourth recess 58.

The restriction hole 212 in the gasket 38 faces the end of the first communication passage 82, and the filter opening 208 faces the end of the second communication passage 84.

With the gasket 38 being mounted on the rear surface 22*a* of the fixed scroll 22, the mating surface 172 of the rear housing 14 is held in abutment against the gasket 38 such that the oil separation pipe 52 of the fixed scroll 22 is inserted in the separation chamber 62. The second partition wall 206 of the gasket 38 is now held in abutment against the opening of the separation chamber 62 while covering the opening thereof, thereby closing the separation chamber 62. As the flange 68 of the oil separation pipe 52 is sandwiched between the second partition wall 206 and the fixed scroll 22, the oil separation pipe 52 is held between the fixed scroll 22 and the rear housing 14 by the flange 68.

The outlet chamber 40 in the rear housing 14 faces the outlet hole 42 and the first and third recesses 50, 56 in the fixed scroll 22 through the outlet opening 196 in the gasket 38, the separation chamber 62 faces the oil separation pipe 52 through the separation opening 202, and the oil storage chamber 80 faces the fourth recess 58 through the oil storage opening 198.

The discharge chamber 64 faces the second recess 54 through the discharge opening 200, and the opening area of the supply passage 34 faces the end of the first communication passage 82 through the restriction hole 212. A portion of the discharge chamber 64 is covered by the first partition wall 204 of the gasket 38.

The filter chamber 88 faces the end of the second communication passage 84 through the filter opening 208, and the holder case 192 of the filter 86 disposed in the filter chamber 88 is covered by the third partition wall 210. The filter 86 is thus held in the filter chamber 88 under pressing forces from the fixed scroll 22 with the holder case 192 being pressed by the third partition wall 210.

The end of the oil supply groove 90 faces the other end of the second communication passage 84 through the gasket 38, and the other end of the oil supply groove 90 faces the supply passage 34.

The bolts 94 are inserted through third bolt holes 98 in the rear housing 14 to the gasket 38, and successively through the second bolt holes 96 in the gasket 38 and the first bolt holes 92 in the fixed scroll 22. Thereafter, the bolts 94 are threaded into the screw holes 100 in the front housing 12, thereby integrally assembling the rear housing 14, the gasket 38, and the fixed scroll 22 on the front housing 12.

As all the outlet chamber 40, the separation chamber 62, the oil storage chamber 80, the discharge chamber 64, and the filter chamber 88 are provided concavely in the axial direction of the rear housing 14, the outlet chamber 40, the separation chamber 62, the oil storage chamber 80, and the discharge chamber 64 may be machined in the mating surface 172 of the rear housing 14 only in one direction. Therefore, the process of machining the rear housing 14 is shortened to increase the efficiency with which to produce the rear housing 14.

The first and second inlet passages 182, 184 which provide fluid communication between the outlet chamber 40 and the separation chamber 62, and the third and fourth inlet passages 194*a*, 194*b* which provide fluid communication between the oil storage chamber 80 and the filter chamber 88 are defined in positions facing the mating surface 172 of the rear housing 14. The first communication passage 82 which provides fluid communication between the separation chamber 62 and the oil storage chamber 80, and the second communication passage 84 which provides fluid communication between the filter chamber 88 and the oil supply groove 90 are defined in the rear surface 22*a* of the fixed scroll 22. Accordingly, it is easy to machine the passages which provide fluid communication between the compartment chambers such as the outlet chamber 40, etc. in the mating surface 172 of the rear housing 14 and in the rear surface 22*a* of the fixed scroll 22.

Since the gasket 38 is sandwiched between the rear surface 22*a* of the fixed scroll 22 and the mating surface 172 of the rear housing 14, the compartment chambers and the passages that are defined in the rear housing 14 and the fixed scroll 22 can reliably be sealed by the single gasket 38.

When the fixed scroll 22 and the rear housing 14 are coupled to each other with the gasket 38 interposed therebetween, the first and third recesses 50, 56 which are concave away from the outlet chamber 40 are defined in the positions facing the outlet chamber 40. Consequently, the volume of the outlet chamber 40 can easily be increased. Similarly, the second recess 54 which is concave away from the discharge chamber 64 is defined in the position facing the discharge chamber 64, and the fourth recess 58 which is concave away from the oil storage chamber 80 is defined in the position facing the oil storage chamber 80. Therefore, the volumes of the discharge chamber 64 and the oil storage chamber 80 can be increased.

Operation and advantages of the scroll compressor 10 thus constructed will be described below.

When the electromagnetic clutch 160 is operated to transmit the rotational power to the rotational shaft 116, the support 124 is rotated by the second bearing 126, and the pin 128 fixed to the support 124 orbits eccentrically around the axis of the rotational shaft 116.

The bushing 134 is rotated by the pin 128 and the Oldham ring 144 slides while being prevented from rotating about its own axis. The movable scroll 24 is slidably supported by a sliding portion of the thrust plate 142. Therefore, the movable scroll 24 orbits with respect to the fixed scroll 22 while the movable scroll 24 is being prevented from rotating about its own axis. As a result, the compression chamber 110 defined between the fixed scroll 22 and the movable scroll 24 is progressively displaced from the outer circumferential region toward the central region, progressively compressing the fluid introduced into the suction chamber 104 and sealed by the sealing member 112. The compressed fluid exerts its pressure to move the outlet valve 44 away from the outlet hole 42, and flows from the outlet hole 42 into the outlet chamber 40.

The compressed fluid is then introduced from the outlet chamber 40 through the first and second inlet passages 182, 184 into the separation chamber 62. At this time, since the fluid is introduced tangentially to the inner circumferential surface of the separation chamber 62, the fluid swirls along the inner circumferential surface in the clearance 188 between the tube 66 of the oil separation pipe 52 and the inner circumferential surface. The lubricating oil contained in the fluid is centrifugally separated from the fluid toward the inner circumferential surface under centrifugal forces produced by the swirling flow.

The fluid, from which the lubricating oil is separated, flows from the clearance 188 between the separation chamber 62 and the tube 66 through the passage 70 in the oil separation pipe 52 to the flange 68. After the fluid flows into the second recess 54 in the fixed scroll 22, the fluid is introduced into the discharge chamber 64 in the rear housing 14. As a result, the fluid is discharged through the outlet port 18 which is held in fluid communication with the discharge chamber 64, into the refrigerant circulating system, not shown.

As shown in FIG. 12, after the lubricating oil which is separated from the fluid, flows along the inner circumferential surface of the separation chamber 62, the lubricating oil flows through the outlet passage 186 defined in the bottom 62*a* to the mating surface 172. The flow rate of the lubricating oil is limited to a certain rate by the restriction hole 212 in the gasket 38 which faces the outlet passage 186. Then, the lubricating oil is introduced through the first communication passage 82 in the fixed scroll 22 which faces the restriction hole 212, into the oil storage chamber 80 in the rear housing 14, and is stored in the oil storage chamber 80. At this time, since the flow rate of the lubricating oil introduced into the oil storage chamber 80 is made lower than the flow rate thereof through the outlet passage 186 by the restriction hole 212, the lubricating oil is introduced gradually into the oil storage chamber 80. Consequently, the level of the lubricating oil in the oil storage chamber 80 is not disturbed, but remains stable at all times.

The lubricating oil stored in the oil storage chamber 80 flows through the third and fourth inlet passages 194*a*, 194*b* into the filter chamber 88 adjacent to the oil storage chamber 80. Dust, etc. contained in the lubricating oil is removed by the filter element 190 disposed in the filter chamber 88. The dust, etc. removed by the filter 86 remains left in the filter chamber 88 and is prevented from entering the oil storage chamber 80 again.

The lubricating oil filtered by the filter 86 is supplied through the filter opening 208 and the second communication passage 84 in the fixed scroll 22, into the oil supply groove 90 in the rear housing 14. The lubricating oil flows along the oil supply groove 90 into the supply passage 34 connected to the other end of the oil supply groove 90.

Finally, the lubricating oil is discharged from the supply passage 34 through the oil supply hole 32 into the guide passage 30, and flows along the guide passage 30 to the movable scroll 24. At this time, the lubricating oil is supplied to sliding portions of the movable base plate 106 of the movable scroll 24 and the fixed spiral wall 28 to lubricate the sliding portions.

The lubricating oil is gradually stored in the oil storage reservoir 114 which is surrounded by the dam walls 36 disposed on each side of the guide passage 30, the guide passage 30, and the movable base plate 106 of the movable scroll 24, and has its oil level increasing. When the end face of the movable base plate 106 is displaced to a position lower than the oil level (see the two-dot-and-dash lines in FIG. 4) due to the orbiting movement of the movable scroll 24, the lubricating oil flows over the movable base plate 106 along the outer wall surface of the movable scroll 24 to the bushing 134 and the rotational shaft 116. The actuating parts including the second bearing 126, the orbital bearing 132, the bushing 134, the rotational shaft 116, etc. are now lubricated by the lubricating oil.

According to the present embodiment, as described above, the supply passage 34 is defined axially in the fixed base plate 26 of the fixed scroll 22, and is held in fluid communication with the oil supply hole 32 defined in the fixed base plate 26 on the movable scroll 24 side. Since the supply passage 34 is spaced from the sliding portions of the fixed spiral wall 28 of the fixed scroll 22 and the movable base plate 106 of the movable scroll 24, dust, etc. produced by the sliding portions when they slide against each other is prevented from entering the supply passage 34.

Therefore, it is not necessary to provide a clogging prevention means such as a counterbore having a diameter larger than the oil supply hole, in the opening of the oil supply hole, as is the case with the conventional scroll compressor, and a clogging for the lubricating oil in the oil supply hole 32 and the supply passage 34 is prevented with a simple structure.

The supply passage 34 may be defined over an axial length in the fixed base plate 26, and can be machined more easily than if an elongate oil supply passage is defined along the fixed side plate and the fixed spiral member of the fixed scroll of the conventional scroll compressor.

The sliding portions of the fixed spiral wall 28 and the movable base plate 106 can be lubricated by the lubricating oil that flows through the guide passage 30 which faces the movable base plate 106. There is no concern about a clogging for the lubricating oil and the sliding portions can reliably and appropriately be lubricated, compared with the conventional scroll compressor in which the sliding portions are lubricated by the lubricating oil supplied from the oil supply hole facing the sliding portions.

The volume of the oil storage reservoir 114 can be varied by the distance that the movable base plate 106 is radially displaced with respect to the dam walls 36 upon orbiting movement of the movable scroll 24. Consequently, maximum and minimum values of the volume of the oil storage reservoir 114 can be set to desired values by the distance that the movable base plate 106 is radially displaced. Thus, the distance that the movable base plate 106 is radially inwardly displaced may be controlled to control the flow rate of the lubricating oil that flows beyond the movable base plate 106 into the actuating parts by which the movable scroll 24 is orbitally held, for thereby freely setting the ratio of the supply amount of the lubricating oil supplied when the actuating parts are lubricated by the lubricating oil, to the supply amount of the lubricating oil supplied when the sliding portions of the fixed spiral wall 28 and the movable base plate 106 are lubricated by the lubricating oil.

Furthermore, since the lubricating oil in the oil storage reservoir 114 can flow beyond the movable base plate 106 toward the movable scroll 24 only when the movable base plate 106 of the movable scroll 24 is displaced, the lubricating oil can flow reliably in one direction only.

The volume of the oil storage reservoir 114 may be set to a minimum value of 0 when the movable base plate 106 is radially inwardly displaced to open the end of the guide passage 30 facing the movable base plate 106, so that the entire amount of the lubricating oil stored in the oil storage reservoir 114 can be supplied to the second bearing 126, the orbital bearing 132, etc. by which the movable scroll 24 is orbitally held. Therefore, the second bearing 126, etc. can reliably and appropriately be lubricated for increased durability and reliability.

The second bearing 126 and the orbital bearing 132 by which the movable scroll 24 is orbitally held can be lubricated when the lubricating oil stored in the oil storage reservoir 114 is supplied beyond the movable base plate 106 upon radial displacement of the movable base plate 106. Accordingly, the second bearing 126 and the orbital bearing 132 can reliably and appropriately be lubricated without the supply passage 34 being clogged.

Since the dam walls 36 are of the same height as the outer circumferential surface of the fixed spiral wall 28, the dam walls 36 can be formed by a cutting process using an end mill or the like at the same time that the fixed spiral wall 28 is machined, and hence can be machined easily.

The invention claimed is:

1. A scroll compressor comprising an outlet chamber defined between a housing and a fixed scroll having a fixed base plate and a fixed spiral wall upstanding on the fixed base plate, for being supplied with a fluid which is compressed by orbiting movement of a movable scroll interleaving said fixed scroll, a separation chamber held in fluid communication with said outlet chamber, for separating a lubricating oil contained in said fluid, and an oil storage chamber held in fluid communication with said separation chamber, for storing said lubricating oil, wherein said fixed scroll includes a guide passage configured to receive the oil from an oil supply hole which is defined in said fixed base plate for flowing said lubricating oil, and extending in an outer circumferential portion of said fixed spiral wall from said fixed base plate along an axial direction of said fixed scroll;

said guide passage being defined by a groove formed on an outer surface of the fixed spiral wall, the groove being open radially and outwardly relative to an axis of the fixed scroll.

2. A scroll compressor comprising an outlet chamber defined between a housing and a fixed scroll having a fixed base plate and a fixed spiral wall upstanding on the fixed base plate, for being supplied with a fluid which is compressed by orbiting movement of a movable scroll interleaving said fixed scroll, a separation chamber held in fluid communication with said outlet chamber, for separating a lubricating oil contained in said fluid, and an oil storage chamber held in fluid communication with said separation chamber, for storing said lubricating oil, wherein said fixed scroll includes an oil passage configured to receive the oil from an oil supply hole which is defined in said fixed base plate for flowing said lubricating oil, and extending in an outer circumferential portion of said fixed spiral wall from said fixed base plate along an axial direction of said fixed scroll; and at least one wall upstanding on an outer surface of the fixed spiral wall to form the oil passage, the at least one wall upstanding radially and outwardly relative to the axis of the fixed scroll along said oil passage.

3. A scroll compressor according to claim 2, comprising:

an oil storage reservoir surrounded by said oil passage, walls, and a movable base plate of said movable scroll which faces said fixed base plate, wherein said lubricating oil discharged from said oil supply hole is stored in said oil storage reservoir.

4. A scroll compressor according to claim 3, wherein the volume of the fluid in said oil storage reservoir varies depending on the distance that said movable base plate is radially displaced with respect to said walls upon orbiting movement of said movable scroll.

5. A scroll compressor according to claim 4, wherein the volume of the fluid in said oil storage reservoir is set to a minimum value of 0 when said movable base plate is displaced radially inwardly from said fixed spiral wall with said oil passage defined therein.

* * * * *